United States Patent [19]

Barata et al.

[11] 4,314,533

[45] Feb. 9, 1982

[54] ROTARY ENGINE EMPLOYING DOUBLE ECCENTRIC

[76] Inventors: Jose M. B. Barata, Mayor St. of Sarria No. 216; Alejandro S. Valls, Travesera of Gracia No. 33, both of Barcelona, Spain

[21] Appl. No.: 86,187

[22] Filed: Oct. 18, 1979

[51] Int. Cl.[3] ..... F02B 53/00

[52] U.S. Cl. ..... 123/242; 418/61 R

[58] Field of Search ..... 123/242, 243; 418/61 R

[56] References Cited

U.S. PATENT DOCUMENTS

| | | | |
|---|---|---|---|
| 3,200,796 | 8/1965 | Kraic et al. | 418/61 R |
| 3,511,584 | 5/1970 | Vierling | 418/61 R |
| 3,951,112 | 4/1976 | Hunter | 418/61 R X |
| 4,111,617 | 9/1978 | Gale et al. | 418/61 B |

FOREIGN PATENT DOCUMENTS

| | | | |
|---|---|---|---|
| 2349247 | 4/1974 | Fed. Rep. of Germany | 418/61 R |
| 463918 | 12/1913 | France | 123/236 |

*Primary Examiner*—Michael Koczo, Jr.

*Attorney, Agent, or Firm*—Blanchard, Flynn, Thiel, Boutell & Tanis

[57] ABSTRACT

A rotary engine wherein a piston is moving within the inside of a cylindrical housing describing its geometrical center or shaft a hypocycloid while the remaining points are generated by a circumference gyrating in the inside of a hypocycloid. The piston is formed by a cylindrical drum with projecting radial vanes. The drum is supported by a crank mechanism which includes a first crank rotatable about the crankshaft and a second crank eccentrically rotatably supported on the first crank. The drum is rotatably supported on the second crank, and a pinion associated with the second crank meshingly reacts with a stationary crown gear, whereby the drum moves along said hypocycloidal path.

28 Claims, 20 Drawing Figures

ROTARY ENGINE EMPLOYING DOUBLE ECCENTRIC

BACKGROUND OF THE INVENTION

The present invention relates to improvements in a system for a rotary engine of the type which basically consists of a cylinder inside of which, and in the axial sense, a drum rotates which is provided with vanes which fit against the internal wall of the cylinder. A shaft passes through the geometrical center of this cylinder, and about this vanes rotate freely at angles which are mutually independent. On this shaft there is provided, in a rigid manner, one or more cylindrical eccentric parts about which the drum, performing the function of the piston, rotates freely. Concentrically with the drum, a pinion is provided which is arranged laterally with respect to the drum, and concentrically with respect to the cylinder, and a crown wheel having internal teeth is arranged at the side of the cylinder, the teeth engaging with further teeth in one single plane. The drum is provided with openings in the axial sense, through which the vanes pass, and bearings are provided between these openings and the vanes which allow the vanes to slide with respect to each other so that the relative angle between them is able to change.

The present invention relates to an internal combustion engine which basically consists of a cylinder inside of which a drum rotates in the axial sense, the drum being provided with two types of motion, one of which is rotation about its own axis and the other of which is a translatory movement which the axis itself is obliged to perform, by virtue of particular mechanisms which are provided for in this invention, a path which in this case is not circular but rather is hypocycloidal, which is the feature which differentiates and characterizes this engine and provides it with certain special characteristics which distinguish its volumetric, thermal and mechanical performance, as well as its cyclic motion and the curves showing its operation.

One of the particular aims of the present invention is to provide the possibility of displacing the geometric axis of the drum or piston so that it performs a hypocycloidal translatory motion which in this particular case will be elliptical as a result of the gearing relationship.

One of the advantages resulting from a drum which is provided with this type of motion is that at the point in time when, together with the vanes, a chamber of minimum volume is constituted, this does not then swing about its center, but rather the point of swinging becomes displaced towards the rear portion with a degree of de-phasing which depends on the relationship between the two superimposed eccentricities. This makes it possible for the perimeter or side of the drum between two vanes to have a radius which is almost equal to that of the cylinder and further makes it possible to adjust this since the volume of the chamber when it is at its smallest size will tend towards zero and consequently the volumetric ratio will tend to infinity, thus making it possible to provide the drum with combustion chambers having the most suitable volume and located at the most suitable position. On the other hand, when ignition occurs with this system, the chamber will expand in a manner similar to that of a fan centered on the rear vane, as a result of which all the pressure which is now concentrated on the drum, imposes a positive expansive motion on it, and at practically all points from the beginning onwards.

A further aim of the invention is to arrange for the displacements of the drum and, as a result of this the volumetric ratios, to be unequal at the differing stages in the working cycle, so that it is possible for the stroke during the intake and exhaust periods to be less than that during the compression and combustion operations, or even for the strokes and swept volumes to all be different.

The main advantage of these unequal displacements of the piston or drum is that, as the travel during the combustion stage can be greater than that during the intake stage, without this affecting the compression ratio which may be very high, as, since the gases which have burnt or are in the process of combustion now for this reason having a greater volume and a larger degree of travel over which to perform their expansion, when the exhaust stage starts, the pressure existing in the chamber will consequently have been reduced and this difference in pressure is turned into driving power, as a result of which the energy yield is increased. Due to the fact that the cubic capacity of a volumetric engine is measured using the maximum capacity for induction at a particular point in the cycle, this increase in volume which is developed during the driving stroke does not affect the cubic capacity of the engine.

A further aim of the invention is to make it possible to locate the inlet and exhaust ports on one or both lateral walls which close the drum located within the cylinder so that, in this way, they can be opened or closed cyclically by the drum itself at the appropriate time, without there being any need, in order to provide for this, to have recourse to superfluous moving mechanisms or masses. This is possible because now that the paths described by the drum have been extended, by providing the elliptical motion of its center, the ports and also the openings which are provided laterally in the drum for this purpose can be constructed so as to have dimensions which are quite adequate for their correct operation.

The main advantages resulting from this mechanism which provides the drum with a special motion which changes its cycle of travel are: (a) it is possible to increase considerably the ratio of the eccentricity which leads to an increase in the volumetric capacity for the same overall volume or the volume of the cylinder, (b) it is possible to increase the compond force which acts perpendicularly on the arm of the crankshaft, mainly during the first half of the driving stroke when the pressure is at its greatest, (c) it is possible to increase the length and volume of expansion during the driving stroke with respect to the intake stroke, (d) it is possible to increase the compression ratio, (e) the effect is obtainable, when ignition occurs, that the sector of the drum located between two vanes does not tilt and become separated simultaneously at all points from the wall of the cylinder, these parts taken together constituting the same chamber, avoiding in this way spilling over which can make ignition extremely difficult, and thus making it possible to obtain a high degree of efficiency at the time of ignition or injection, (f) it is possible to eliminate every type of moving auxiliary mechanism or mass used for the specific function of opening or closing the ports or valves, (g) it is possible to provide communication in a very simple manner under working conditions between the inlet ports and the core of the drum since when the induction is performed through this, it is possible to cool and at the same time lubricate the vanes, the bearings, the drum and the other internal parts of the engine. Consequently, a better power output is achieved since the power developed by an engine is not only measured by the number of driving strokes per unit time but also by the degree of efficiency of these.

In one aspect of the invention, the drum is mounted on a crank or cranks and because of this, it is possible to eliminate the eccentric part(s) which is located on the shaft which passed through the geometrical center of the cylinder and which limited the degree of eccentricity of the drum with respect to the diameter of the cylinder. One essential characteristic of these cranks, which take on the function of eccentric parts, consists in the fact that they are followed by a second eccentric part which rotates cyclically in such a way that this is superimposed on the axis of eccentricity or arm of the crank in a direction of rotation which is the same as that of the drum. This rotation of the second eccentric part is produced since the arm of the crank which describes a circumference is not rigidly fixed, but rather rotates. This arm is basically made up by three elementary parts. The first consists of a cylinder, the axis of which is parallel to but eccentrically offset with respect to the axis of the arm, as a result of which it operates as a second eccentric part on which the drum is free to rotate by means of bearings. The second is made up by a spacing which is designed to house bearings which allows it to rotate about the geometrical center of the arm of the crank. The third part consists of a pinion arranged concentrically with respect to the arm and the effective diameter of which is equal to the rotational circular path described by its center, which is imposed upon it due to the rotation of the crank.

This pinion engages with an internally toothed crown wheel arranged concentrically with respect to the axis of rotation of the crank and the effective diameter of which is equal to twice the circumference described by the arm of the crank.

Using this gearing relationship the resulting effect is that when the crank has made one complete revolution, the pinion, which together with the second eccentric part constitutes its arm, will also have performed one complete revolution in the opposing sense, but when the second eccentric part has performed this complete revolution, or two revolutions with respect to the crank due to revolving in opposing senses, the drum which revolves about it will have performed one-third of a revolution in the same sense.

Independently of this gearing relationship between the pinion and the crown wheel which has just been described and which taken overall constitutes the crank system which is one particular feature of the invention, there is present, as is common with this type of motor, a pinion located on the drum or piston and arranged concentrically with respect to it and this engages with a circular crown wheel having internal toothing arranged concentrically with respect to the cylinder and which impresses on it, as a result of this gearing, a rotational motion which is in the reverse sense with respect to its orbit using a ratio of diameters which depends on the number of vanes, but more in particular, since the engine which is the object of the invention has the particular feature that the drum is mounted on a combination of superimposed or series connected eccentric parts as a result of which its axis does not describe a circular path, the pinion which is arranged concentrically with respect to the drum is not able to engage with a circular crown wheel, but rather in this case the latter must be provided with a hypocycloidal perimeter over which it engages, which in this particular case will be elliptical. The effective major radius of this elliptical crown wheel will be equal to four times the radius of eccentricity of the geometrical axis of the arm of the crank, plus the radius of eccentricity of the second eccentric part which is superimposed on this radius, and the minor effective radius will be equal to four times the radius of eccentricity of the arm of the crank minus the radius of eccentricity of the second eccentric part.

In order to clarify the basic concepts which characterize and substantially modify this type of engine, several sheets of drawings are attached to the present description which are provided solely by way of example, in which the most salient features of the invention are shown.

DETAILED DESCRIPTION

Figures 1, 2:
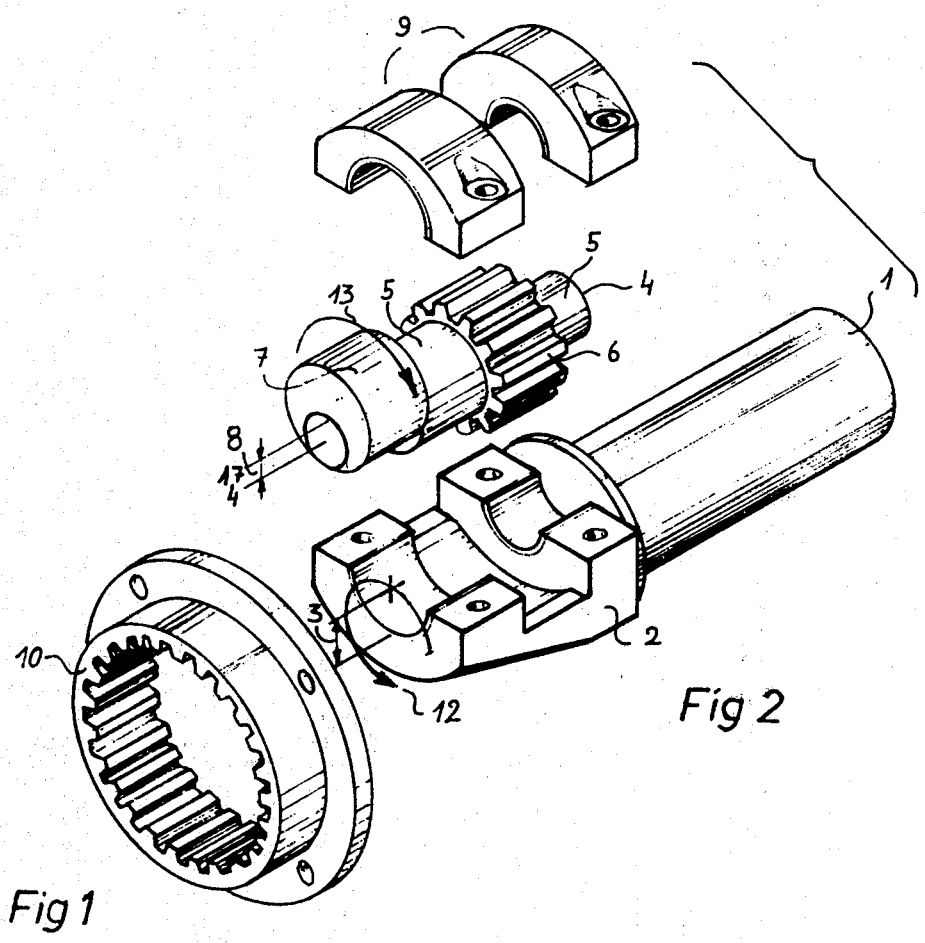
FIGS. 1 and 2 show, perspectively, the parts that make up the crank mechanism.

FIGS. 1 and 2 show, in diagrammatical perspective view, the parts which make up the crank where the following items can be seen: the power output shaft of the engine 1 having fixed thereto the support or crank 2 which rotatably and eccentrically houses the arm 4 and allows it to rotate parallel to shaft 1 but with an eccentricity 3. The arm 4 is basically made up firstly by a pair of axially-spaced supports or bearing hubs 5 which are of different diameters, secondly by pinion 6 coaxially fixedly positioned between hubs 5, and thirdly by the cylindrical eccentric part 7 mounted on the end of the arm and having a radius or arm of eccentricity 8. The bearing shells 9 can also be seen which together with part 2 rotatably mount the shaft 4. The internally toothed crown wheel 10, which meshes with gear 6, of the crank is statically arranged concentrically with respect to shaft 1. The effective diameter of pinion 6 is equal to twice the radius of eccentricity 3 of the crank, and the effective diameter of the crown wheel 10 is equal to twice the effective diameter of pinion 6 or, in other words, the number of teeth of the crown wheel is twice that of the number of teeth on pinion 6.

Figures 10, 11:
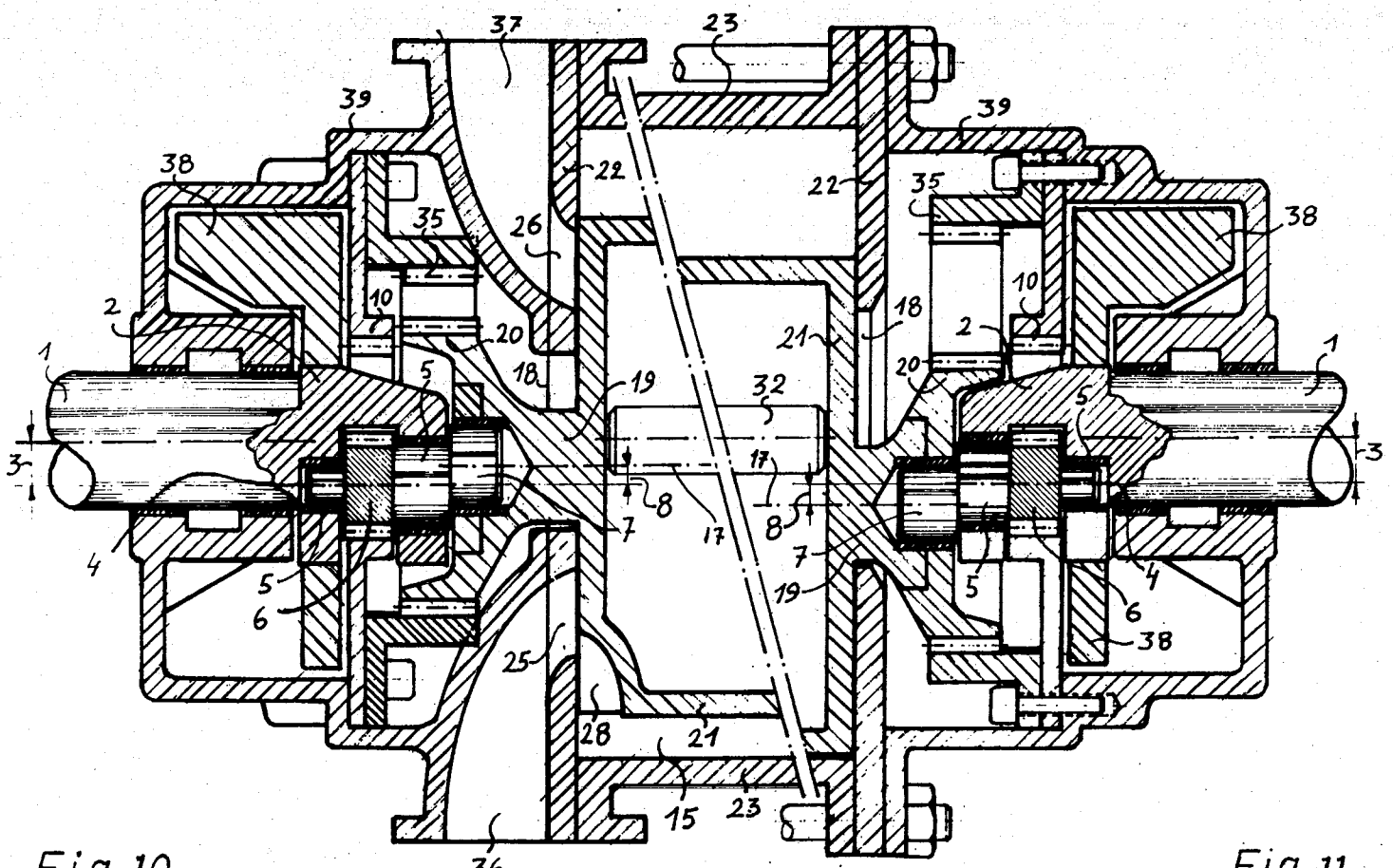
FIG. 10 is an axial cross section of the engine as taken along line A-B-C in FIG. 4.
FIG. 11 is an axial cross-sectional view along line D-B-E in FIG. 4.
Figure 13:
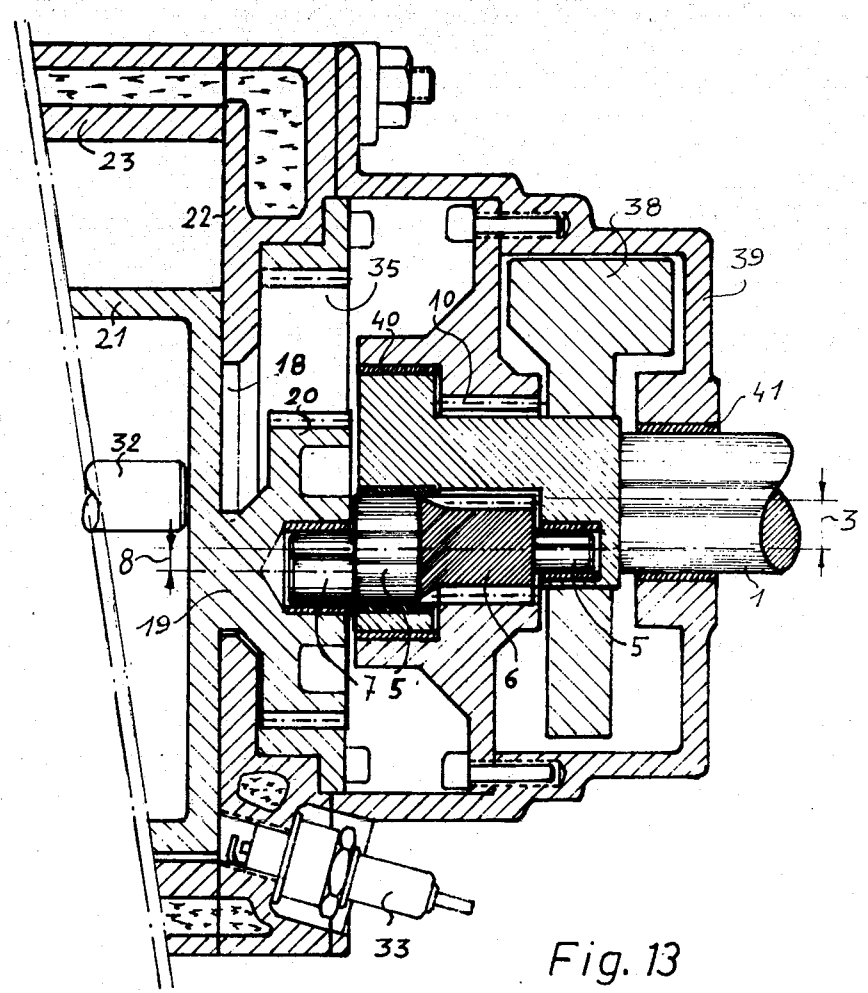
FIG. 13 is an axial cross-sectional view similar to FIG. 11 but showing variations.

The crown wheel 10 engages with pinion 6 as can be seen in FIGS. 10, 11 and 13, but with reference to FIGS. 1 and 2, it can be seen that when the crank rotates in the sense indicated by arrow 12, pinion 6 when it is in engagement with crown wheel 10 will rotate in the reverse sense as shown by arrow 13 in a ratio of 2:1, but since they rotate in reverse senses, when shaft 1 has performed one complete revolution in one sense, arm 4 will have only performed one complete revolution in the opposing sense, or in other words they will have performed two revolutions with respect to each other.

It will be seen that as a result of this motion one circumference is rotating within the other of a larger size, with which it is in engagement, as a result of which all the points which are not on the geometrical center of shaft 4 will have described hypocycloids, but since the eccentric part 7 is present on this shaft, and due to the fact that it is eccentric with its geometrical center or axis 17 not coinciding with the axis 4', the result is produced that when rotation of shaft 1 occurs, the center 17 of the eccentric part 7 will describe a hypocycloid, but because of the gearing ratio, which is particular to this special case, this hypocycloid will be elliptical. Since the piston or drum is mounted on this eccentric part 7 (FIGS. 10, 11 and 13), the geometrical center of the drum will also describe an ellipse, the major diameter of which is equal to twice the eccentricity 3 of the crank plus twice the eccentricity 8 of its arm, and the minor diameter will be equal to twice the eccentricity 3 of the crank minus twice the eccentricity 8 of its arm.

Figure 3:
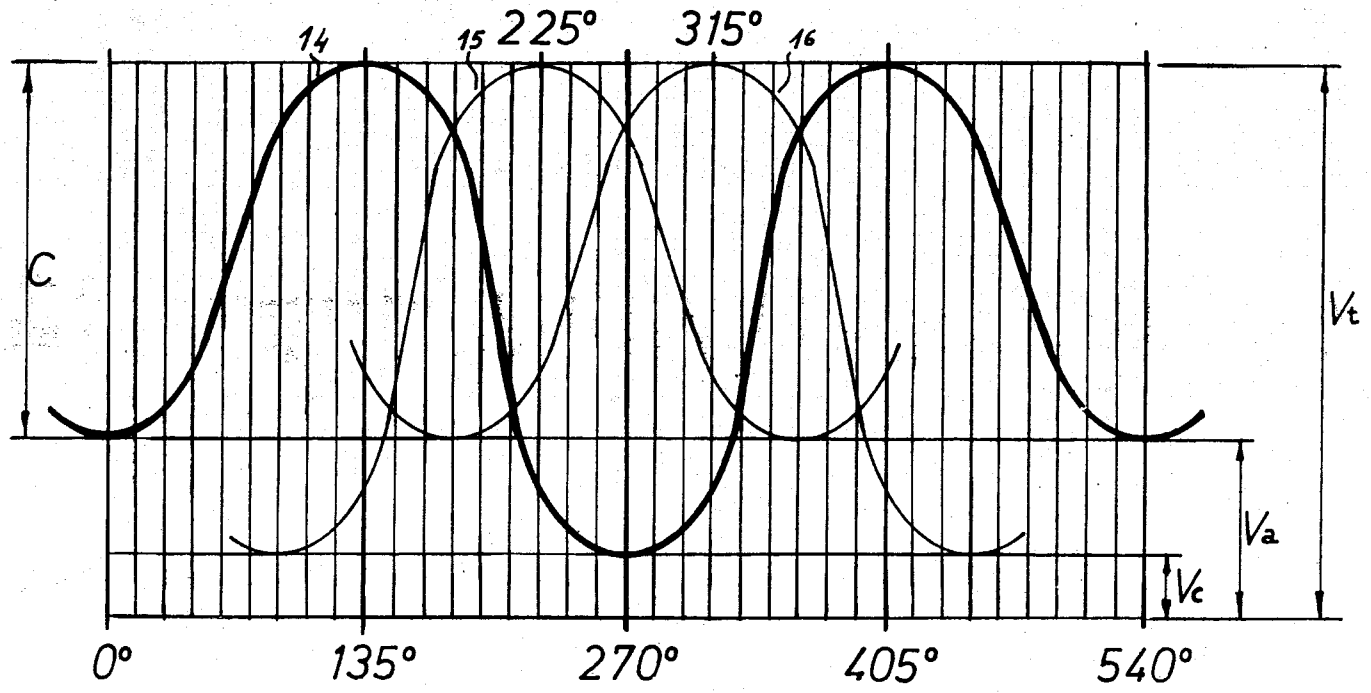
FIG. 3 diagrammatically illustrates the relationship between chamber volume and crank rotation.

FIG. 3 is a diagram which shows the relationship between the angle of rotation of the crank and the volume of the chambers 14, 15 and 16 (FIGS. 5–9) in which it is possible to see how their strokes are unequal and also how their volumes are unequal at their two different top dead centers (TDC); Va and Vc. Volume Va corresponds to the point where the drum is at TDC at the point where the intake stroke is commencing, volume Vc corresponds to the position of the drum at its TDC when a power stroke is about to commence and volume Vt corresponds to the position of the drum at its bottom dead center (BDC) both at the end of an intake stroke as well as at the end of a power stroke.

In the cycle shown in FIG. 3, at the point 0° equivalent to volume Va the inlet valve opens and this remains open up to the point Vt, the crankshaft or power shaft having turned through 135°, and it will be noticed that the capacity for induction or the cubic capacity C for the stroke will be the difference between Vt and Va. Starting from 135°, all the valves are closed and the compression period occurs until 270° is reached and the compression ratio at this point is the volume taken in C, plus the volume of the gases present in the chamber Va which is equal to the total volume Vt divided by the minimum volume Vc, equals Vt:Vc. Between 270° and 405° the power stroke occurs during which the valves or ports remain closed and the volume changes from Vc to Vt. Starting from this point the exhaust valve opens and the volume changes from Vt to Va so that the cycle is able to start again, this actually occurring in the opposing half of the cylinder since the motor is basically symmetrical with respect to the 180° line. One complete cycle thus occurs during one and one-half revolutions of the crankshaft.

Still with reference to FIG. 3, it will be seen how the induction and exhaust strokes are shorter than the compression and combustion strokes, but regardless of this, they all take place within the same period of time which is equivalent to 135° of rotation.

The description which has been provided with reference to the diagram in FIG. 3 has been provided with reference to the most general case, without taking into account overlap, advance or delay in the opening of the valves or ports, since this arrangement can be varied depending on the particular requirements for each engine. The lines 15 and 16 shown in light print have been provided to show the out-of-phase relationship which exists between these three chambers which follow exactly the same path and which will be performing at any particular point the same function, but with a phase difference of 180°. The degrees shown in the diagram relate to the angle of rotation of the crankshaft or crank, but if it is desired to represent these as a function of the rotation of the drum, they should be divided by three.

Figure 4:
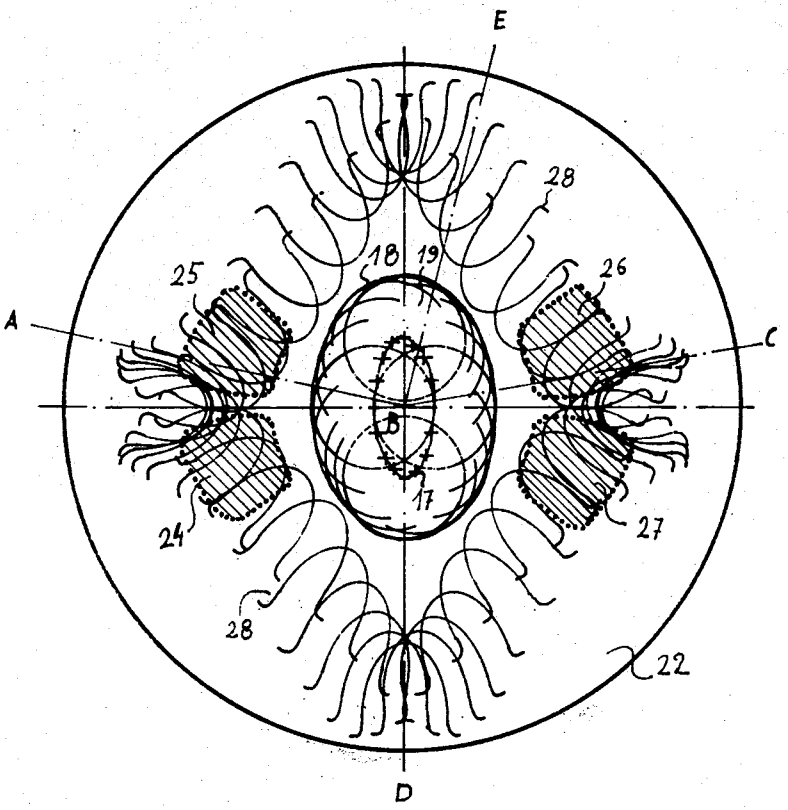
FIG. 4 plots the piston movement during one revolution.

FIG. 4 shows drawings at each 7°30' which indicate the particular movements that some parts of the piston or drum perform during its path through one rotation of 360° which corresponds to three complete orbits or turns of the crankshaft, and these have been shown in this way so that their paths and accelerations can be seen more clearly.

The ellipse 17 in FIG. 4 shows a plot of the path described by the geometrical center of the drum. The circumference 19 represents a cross-section through the output shaft 19 from the drum 21 which connects it to pinion 20 (FIGS. 10, 11 and 13). Ellipse 18 shown in FIG. 4 shows the path described by this shaft 19 during its orbital motion and this defines the minimum central passage 18 which must be provided in the cover 22 which laterally closes the cylinder in order to allow shaft 19 to pass therethrough.

The openings 24, 25, 26 and 27 shown in FIG. 4 and also in FIGS. 5–10 show the inlet ports 24 and 26 and the exhaust ports 25 and 27 or vice-versa, depending on the direction of rotation.

The plurality of lines 28 in FIG. 4 show, during their path of travel, the recesses which are formed laterally in the drum for cyclically opening and closing the inlet and exhaust ports (FIGS. 5–10). To distinguish these recesses 28 from others which are present in the motor, and to provide them with a suitable name, they will be hereinafter referred to as "concavities". The concavities which are located on the same side of the drum pass through the same path.

With reference to FIG. 4, it will be seen that these concavities, which are mutually separated by an identical time interval, are subject to a reduction in velocity when they arrive over the exhaust port 24 or 26, then change in angle and become separated, almost radially from its center. The same thing happens in the inverse sense and symmetrically, when they reach the region of the inlet port 25 or 27, where they first approach almost radially and then almost completely cover it with further rotation.

With reference still to FIG. 4, it will be seen that since the passage 18 is elliptical and the concavities 28 perform a motion which is particular to this invention, it has been made possible to provide the ports with dimensions which are acceptable for their operation.

The graph shown in FIG. 4, which represents the most general case, provides four ports which are identical and arranged symmetrically, but this is not obligatory and the inlet ports may have dimensions which differ from those of the exhaust ports and their location may not be symmetrical with respect ot the latter in order to take advantage of overlap and the inertia of the gases depending on the specific requirements of each individual engine. Furthermore, the four ports have been shown here to be on the same lateral cover of the cylinder but, for example, the inlet ports may be located on one cover and the exhaust ports on the opposing cover or there may be a complete set of inlet and exhaust ports in each cover.

FIGS. 5–9 provide a diagrammatical view of the same radial cross-section of the engine, these having been taken at different points in the working cycle. These diagrams show the three chambers 14, 15 and 16, the volumes of which depend on the angle of rotation, the three concavities 28, the inlet ports 25 and 27 and the exhaust ports 24 and 26, the rotating piston or drum 21, the cylinder 23, the vanes 29,30 and 31, the shaft 32 carrying these vanes, the two ignition sites 33 which in the drawings have been represented as spark plugs by way of example, in order to clarify the explanation.

FIG. 10 shows an axial cross-section of the engine taken along line A-B-C in FIG. 4, and FIG. 11 shows a similar cross-section along line D-B-E in FIG. 4. In both drawings the crank system which was represented above in perspective in FIGS. 1 and 2 can be clearly seen, comprising the power output shaft 1, the crank or support 2 for the arm 4, the radius of eccentricity 3 of the crank, the radius of eccentricity 8 defining the eccentricity of the arm 4, the supports 5, the pinion 6 engaged with the stationary crown wheel 10, and the second eccentric part 7. In addition to the overall crank assembly, the following parts can also be seen: pinion 20 which is rigidly fixed to the drum 21 by means of the shaft or boss 19 which passes through the elliptical passage 18 formed in the lateral or side wall 22 which closes cylinder 23, the stationary elliptical crown wheel or gear 35 which engages the pinion 20, the counterweighted flywheel 38 secured to shaft 1, and the engine casing 39.

In FIG. 10 the inlet port 25 can be seen with its manifold 36 and the exhaust port 26 with its manifold 37. The concavity 28 will also be seen which in the position shown at the start of the intake stroke, will first become displaced almost radially towards its center, and as it is rotating at the same time it will come to coincide with and completely uncover port 25, functioning as shown in FIG. 4.

The two cross-sections shown in FIGS. 10 and 11 have been taken at practically 90° to each other, and in order for the cranks to continue to maintain the same position as shown in these Figures, it has been necessary to provide the crank shown in FIG. 10 with a rotation of 90° with respect to its stator but, as has already been indicated when discussing operation of the crank, when the crank is provided with an angle of rotation in one sense, the second eccentric part 7 will perform the same rotation but in the reverse sense, as a result of which in the position shown in FIG. 10, the second eccentric part 7 will have performed a revolution of 180° with respect to the second eccentric part shown in FIG. 11, the two remaining diametrically opposed.

With reference to FIG. 10 it will be seen that the total radius of eccentricity of the drum 21 is equal to the radius of eccentricity 3 of the crank minus the radius of eccentricity 8 of the second eccentric part 7. If reference is now made to FIG. 11, it will be seen that the total radius of eccentricity of drum 21 is equal to the radius of eccentricity 3 of the crank plus the radius of eccentricity 8 of the second eccentric part. As a result of the above, the ellipse 18 is cut in FIG. 11 through its major axis or diameter and the same ellipse in FIG. 10 is cut through its minor axis or diameter, all this making it possible to locate the ports 25 and 26 in a very suitable manner in the cover 22.

Figure 12:
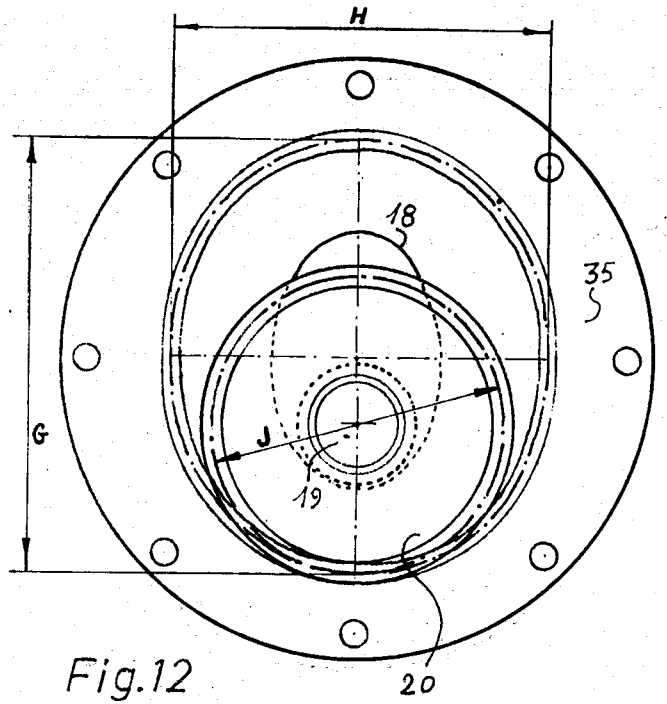
FIG. 12 shows the relationship between the drum pinion and the elliptical crown wheel.

FIG. 12 shows the relationship of the drum pinion 20 with the elliptical crown wheel 35. Pinion 20 has an effective diameter J which must be six times the radius of eccentricity 3 of the crank. The elliptical crown wheel 35 has a stationary inner toothed ring and is mounted concentrically with respect to the cylinder, and its effective major diameter G is equal to eight times the radius of eccentricity 3 of the crank plus two times the radius of eccentricity 8 of the second eccentric part 7, and its effective minor diameter H is equal to eight times the radius of eccentricity 3 minus two times the radius of eccentricity 8 of the second eccentric part 7. Using this relationship, the working cycle of the rotor system takes place at the correct time.

FIG. 13 shows an axial cross-section which is similar to FIG. 11 but which has some variations which have been provided solely by way of an example of constructional details. It will first be seen that the pinion 6 of the crank is located between two supporting bearings 40 and 41 and that its gear train, essentially consisting of the pinion 6 itself, its supports 5 and its eccentric part 7, enters axially into shaft 1 without there being a need for covers. This arrangement avoids a bending moment occurring with respect to the shaft. A further variation is that the elliptical crown wheel 35 is attached to the cover of cylinder 22 instead of to the motor housing 39, and it will also be seen that the ignition site 33 is arranged laterally in the cover 22 so that when it is in this position it is guarded from being struck by the lubricant which, due to centrifugal force it might be in a position to receive, and this arrangement makes it much less likely to become oiled up. This drawing also shows, by way of example, the liquid cooling system for the engine. The remaining mechanisms and provisions are essentially identical to those which were described with reference to FIG. 11 and they have been indicated using the same reference numerals so that the description already provided relates to both Figures.

In FIGS. 10, 11 and 13, the vanes have not been shown nor has the cross-section of the drum been taken through the swivel joints for the sake of clarity of the drawings since these would be represented very badly in these cross-sections and additionally a plurality of engines using vanes do exist which in this particular aspect may have some similarity to the present.

However, each of the vanes 29,30,31 has at its radially inner end an annular eye portion with a cylindrical bore whereby the vane is pivotally mounted on a free shaft 32 (FIGS. 10–11) which remains coaxially aligned with the cylinder 23. This enables each vane to move angularly relative to the other vanes in the manner of the leaves of a hinge.

Having now explained the basic mechanisms, the synchronization will now be discussed, and consequently their operation, and reference should now be made to FIGS. 5–9 which show the same radial cross-section of the engine at different positions in the working cycle.

An arbitrary angle of 0° will be taken as a vertical line located above the center of the cylinder and this will have to be displaceable in both senses, as a result of the orbital movements caused by the combined action of the two superimposed eccentric parts.

Figure 5:
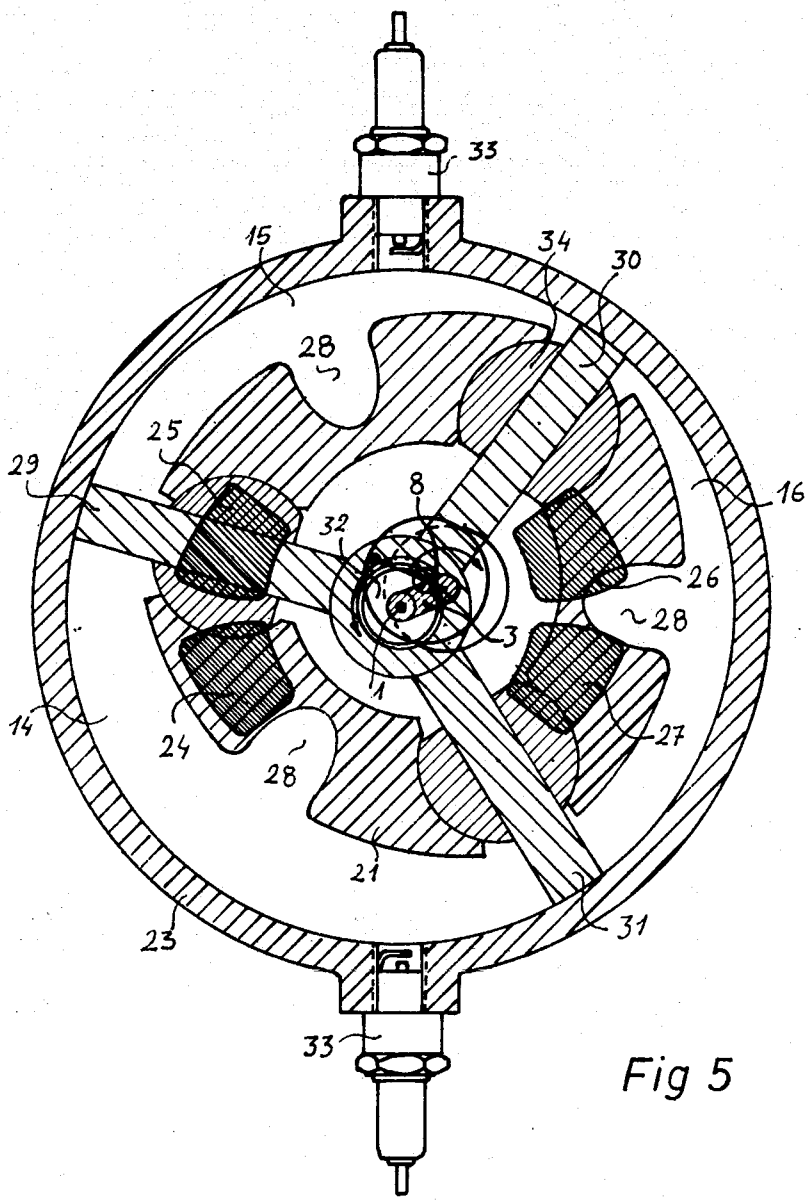
FIGS. 5–9 diagrammatically illustrate the radial cross section of the engine at different points in the working cycle.

With reference now to FIG. 5 it will be seen that the plane of eccentricity 3 of the crank is located at +67°30′ and that as a result of what has been said above, the plane of eccentricity 8 of the second eccentric part 7 will be at the same angle but in the reverse sense, in other words, +292°30′ but this will be referred to as being −67°30′ in order to simplify the explanation. Due to the fact that the pinion 20 on the drum 21 engages the elliptical crown wheel 35 in a ratio of 1 to 3, the drum 21 thus rotates in the same sense as said second eccentric part 7 and will be located at an angle of −22°30′. This position of the drum is not completely correct because its center rotates together with its second eccentric part, and this second eccentric part is in advance of or behind the engagement with the elliptical crown wheel, but since each time the two planes of eccentricity become superimposed this phase difference will be eliminated, and this happens every 90° of rotation of the crankshaft or every 30° of rotation of the drum. It is possible to ignore this phase difference since it has practically no influence on the operation which will now be described, and simply has a favorable effect on the acceleration of the vanes.

In FIG. 5, with this angular relationship synchronized between the various parts, it will be seen that the chamber 14 is performing a power stroke and is almost at the point where it reaches its maximum volume and where the concavity 28 is about to open the exhaust port 24, and it will also be observed that chamber 15 is operating under compression conditions and chamber 16 is almost at the end of an exhaust stroke, the concavity 28 being about to close the exhaust port 26.

Figure 6:
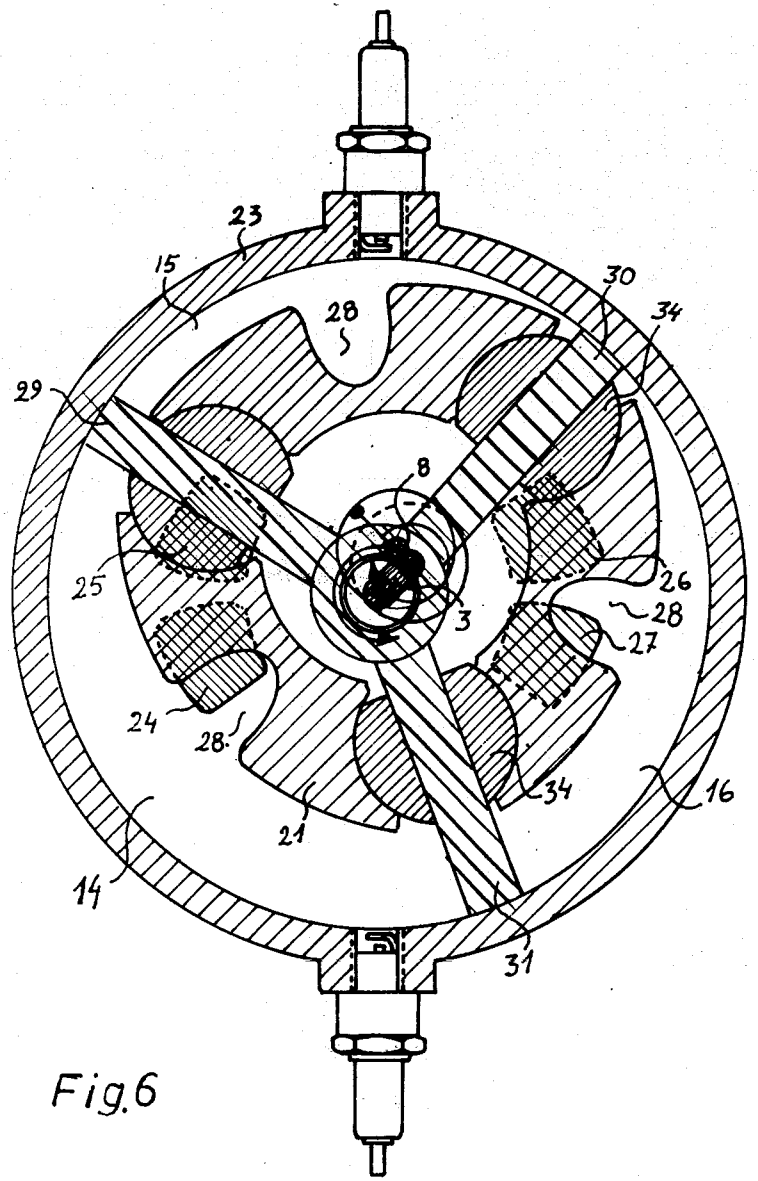

In the position shown in FIG. 6, the plane of eccentricity of the crank is at +45°, the angle of the second eccentric part is −45° and the angle of the drum is −15°, or in other words, comparing this position with FIG. 5, it has turned through 7°15′ in the positive (i.e., clockwise) sense. With reference to FIG. 6, it will be seen that chamber 14 has already started to exhaust since the concavity 28 has opened port 24 at the same time as this chamber starts to reduce in volume. Chamber 15 is continuing its compression period and induction has commenced in chamber 16 since concavity 28 has closed the exhaust port 26 and this same concavity has opened the inlet port 27 as this chamber is increasing in volume.

Figure 7:
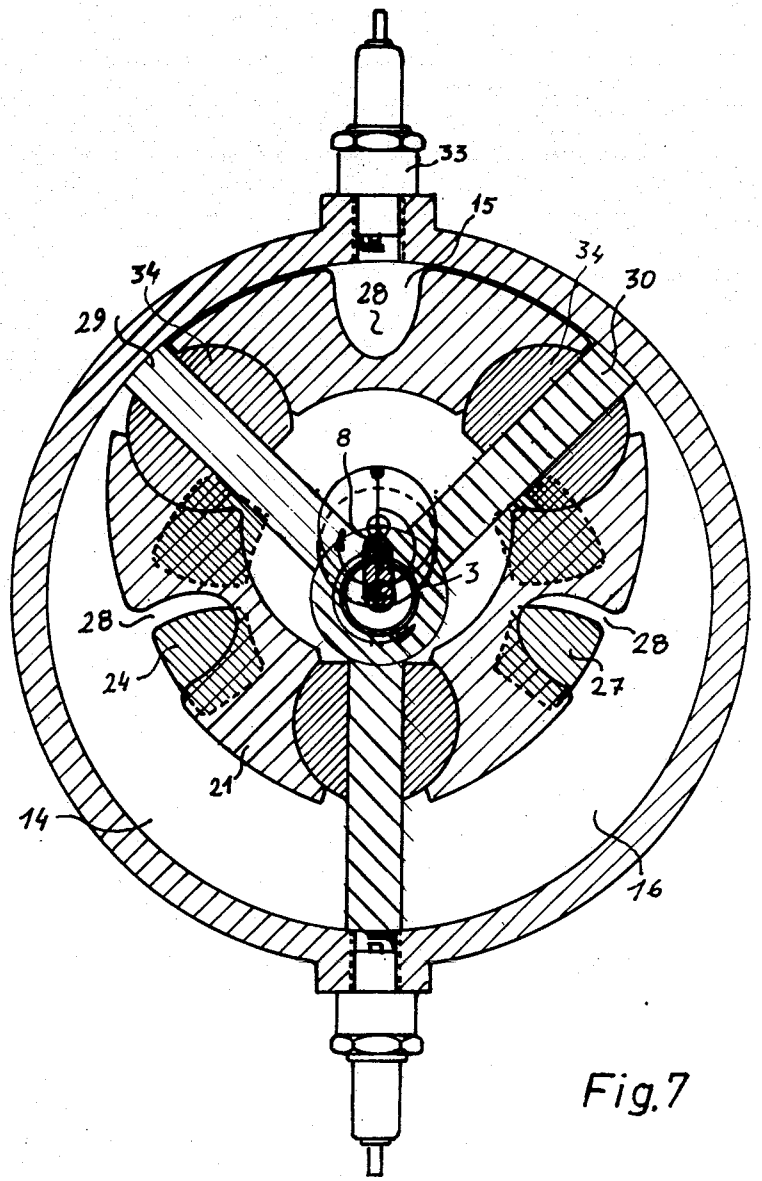

In FIG. 7 the two planes of eccentricity 3 and 8 are superimposed at a position of 0° and consequently the drum is also at 0°, or in other words, when comparing this position with that shown in FIG. 6 the drum has rotated through 15°. In FIG. 7 it will be seen that chamber 14 continues to decrease in volume, while the concavity 28 is keeping the exhaust port 24 open. Chamber 15 has reached TDC (top dead center) and consequently is at its minimum volume, Vc in FIG. 3, ignition or injection being carried out, neglecting at this point any possible advance. Chamber 16 is continuing to increase in volume and the concavity keeps the inlet port open.

Figure 8:
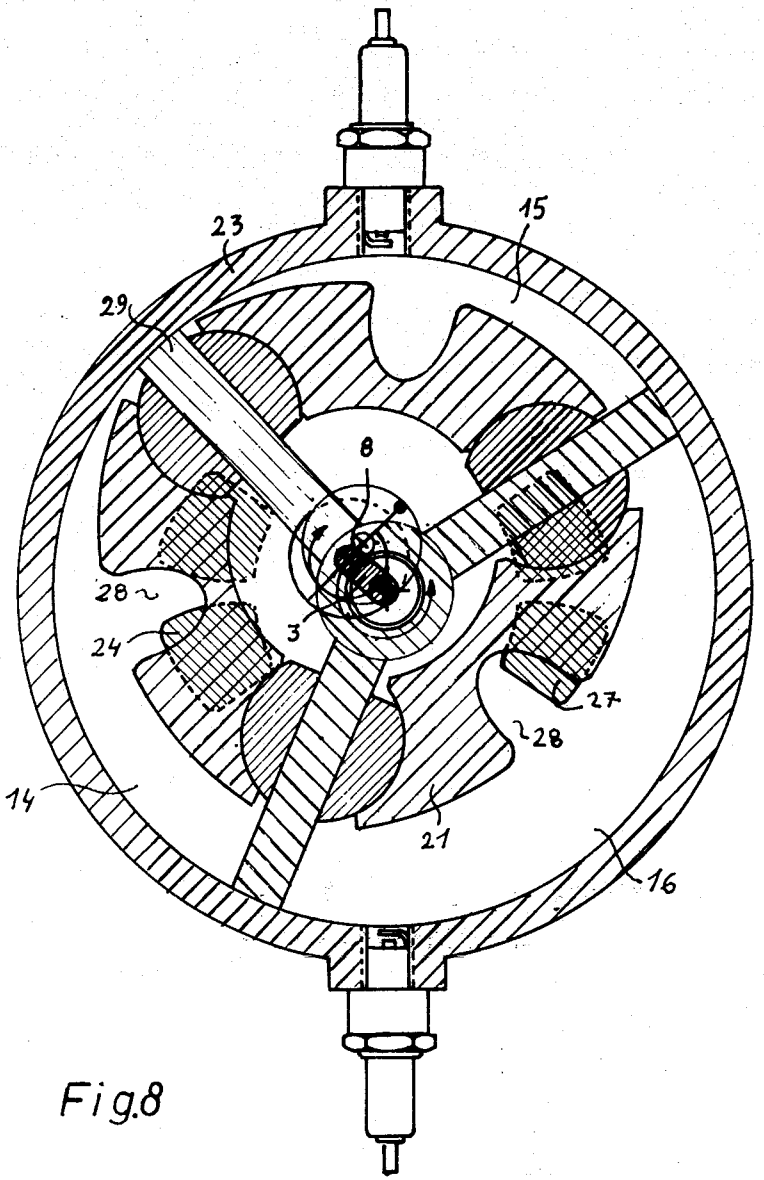

In the position shown in FIG. 8, the drum 21 is at +15° and here it will be seen that chamber 14 is at its exhaust stage, its volume continuing to decrease while the exhaust port 24 remains open. Combustion is occurring in chamber 15 and its volume is increasing and chamber 16 is on the point of reaching its maximum volume while at the same time the concavity is about to close the inlet port 28.

Figure 9:
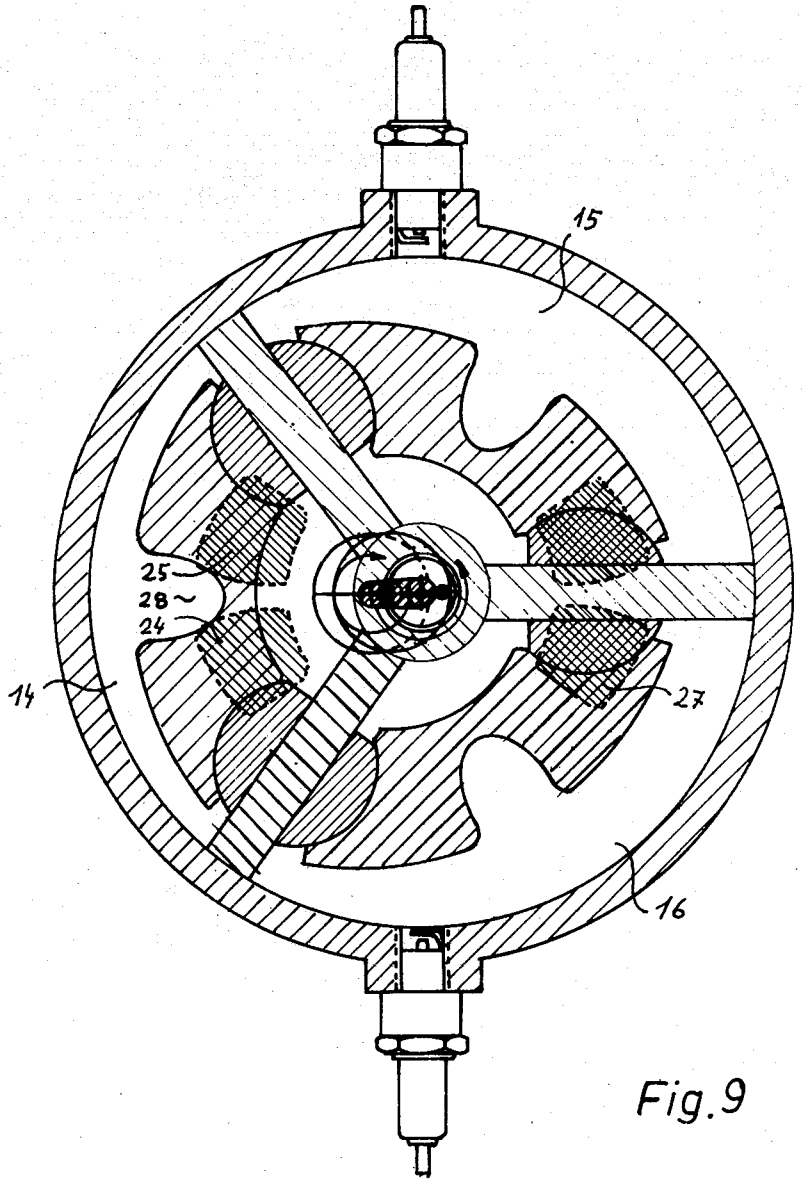

In the position shown in FIG. 9 it will be seen that the plane of eccentricity of the crank is at −90° and that the plane of eccentricity of the second eccentric part is at +90° so that the two planes now coincide again but on this occasion are at 180° with respect to each other, their eccentricities remaining and obliging the drum to be at a position of +30°. In FIG. 9 it will be seen that chamber 14 has reached its minimum volume Va in FIG. 3, at the same time as when concavity 28 has just closed the exhaust port 24 and has started to open the inlet port 25, since as has already been said above, overlap has been eliminated in order to present the most general case. Chamber 15 continues with its combustion period and is increasing in volume, while chamber 16 which is performing a compression stroke is decreasing in volume after having closed the inlet port 27.

One of the main features of the invention is that when the drum together with the vanes defines a chamber of minimum volume, such as chamber 15 of FIG. 7, in order for ignition to occur, the two radii of eccentricity 3 and 8 are added together in the same plane which passes through the line bisecting the angle formed by the vanes defining this chamber, and the maximum distance which it is possible for the drum to have in the plane of this bisecting line from its perimeter to its center is, at its maximum, the radius of cylinder 23 minus the sum of the two eccentricities 3 and 8. If reference is made to corresponding FIGS. 6 and 8 in which the drum 21 is 15° of rotation ahead of and behind the position shown in FIG. 7, it will be seen that in both positions the two eccentricities do not now add up and that they have passed from the position of being in the same plane to a position where they are at 90° with respect to each other. As a result, the maximum radial distance which the drum 21 is able to have in the radial planes of the swivel joints 34 from its perimeter to its center will be, at a maximum, the radius of cylinder 23 minus the radius of eccentricity 3 of the crank minus one-half the radius of eccentricity 8 of the second eccentric part and this is at 90°, as a result of which these three distances from the perimeter of the drum to its center are not equal and if a line is drawn which passes through these three points, which is the perimeter of the drum between the vanes, FIG. 7, it will be seen that its center does not correspond to the geometrical center of the drum 21 but rather that it closely approximates the geometrical center of the cylinder 23, as a result of which it is possible to decrease the volume of the minimum sized chamber constituted.

If the engine were not to be provided with this double eccentricity, which is one of the preferred aims of the invention, the maximum distance which could exist between any particular point on the perimeter of the drum and its center would be equidistant, which of course is the definition of a circumference and consequently the drum would basically be cylindrical. This drum which would rotate through a circular orbit would perform an apparent rolling motion inside the cylinder and this point of rolling, even though there would be no contact, would subdivide the corresponding chamber between two vanes into two pseudo-chambers which would be deformed starting from the moment at which the point of rolling had passed beyond one vane. This rolling motion would increase the volume of the newly created sub-chamber and consequently would decrease the volume of the chamber already in existence, but this variation in volume between these two pseudo-chambers which together would make up the common chamber, would cause a displacement of gases at very great velocity which would be very detrimental to ignition, apart from the fact that when ignition was produced, which would actually be in a position similar to that shown in FIG. 7, the drum, due to the rolling effect, would actually possess a relative swinging motion about its midpoint as a result of which half the drum, in this chamber, would become separated from the cylinder and the other half would come closer to it thus leading to undesirable effects and which furthermore could also encourage detonation.

This brief explanation of the performance of an engine of this type not provided with double eccentricity and which is not an object of the invention, has nevertheless been provided in order to better clarify its different behavior concerning one extremely important aspect which affects the compression and combustion times.

As a comparison with the operation which has just been described for the purposes of clarification only, the performance of the motor provided with double eccentricity will now be described at one of the most decisive stages which occurs when compression has been completed and combustion starts.

In FIG. 7 it will be seen that chamber 15 is at its position of minimum volume and that following from what has been said above, the perimeter or curvature of the drum 21 between the two vanes 29–30 is similar to the curvature of cylinder 23 and thus forms together with the cylinder one single chamber without sub-divisions. But if reference is now made to the graph shown in FIG. 4, in which the motion of the drum is shown, it will be seen that its geometrical center describes an ellipse 17 which obliges the concavities 28 which correspond to its outer surface to descend at an angle which is fairly close to the vertical, thus separating it from the cylinder and preventing its rolling.

If the movement of the drum 21 between the positions shown in FIGS. 6 and 7 is now studied, it will be seen that the gases which have previously been drawn into chamber 15 are being compressed due to the displacement of the drum, which produces a motion somewhat similar to that of a fan with its center located at the free end of vane 30, thus trapping all the gases which will remain in a compressed state in one single chamber 15 without any spill over or superfluous flows having occurred.

In the position shown in FIG. 7, ignition or injection is effected (ignoring advance) which will cause chamber 15 to expand. FIGS. 7 and 8, in a similar, but reversed, manner to the compression period, or in other words with a motion similar to that of a fan but this time centered on the vane 29, but if this motion between the FIGS. 7 and 8 is observed, it will be seen that all the points on the periphery of the drum have almost simultaneously become separated from the wall of the cylinder almost from the beginning, so that all motion caused by the pressure constitutes positive work. It will also be noted from the motion between these two drawings, that the arm of the motor couple, which is its eccentricity, becomes sub-divided into a "scissors" motion due to the effect of the construction using this double eccentricity. This sub-dividing, with one of these being direct and operating on the arm of eccentricity 3 of the crank in one sense and the other being indirect operating in the inverse sense on the arm of eccentricity 8 of the second eccentric part, and the reaction produced due to the engagement between pinion 6 and the crown wheel 10, causes the crank to turn in the same sense as a result of its rack effect, the two forces being added together, thus increasing the couple.

As there are various factors in this engine which come into play when obtaining the effect of one chamber reaching its maximum or minimum volume at a definite angle of the crankshaft with respect to its stator, an engine is shown in FIGS. 14–18 which is basically similar but which has the special feature that the relationship of the eccentric parts, both with respect to each other and with respect to the bisecting line at the point in time in which the vanes constitute an angle of minimum value, are not in the same plane, as would happen with the engine already described with reference to FIG. 7.

Figure 15:
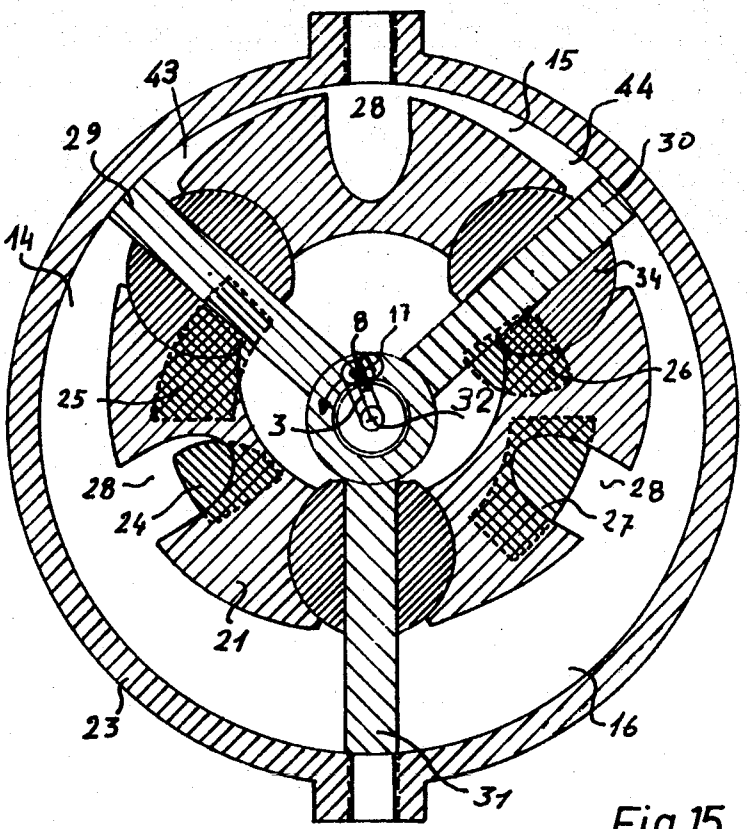
FIG. 15–17 are radial cross-sectional views, at different operational positions, for the modification of FIG. 14.

With reference to FIG. 15, it will be seen that in this position the vanes 29 and 30 have a minimum angle between them and that, in their turn, the arms of eccentricity 3 and 8 are not aligned, either with respect to each other or with respect to the line bisecting the angle between these two vanes. The relative position between these three influencing factors can be varied over an extremely wide range, but while maintaining that this range is possible, by way of example, the relative position shown in FIG. 15 will be described where quite arbitrarily, the angle 0° has been selected to be the bisecting line or a line parallel to this,, between two vanes when the angle between these two vanes is an obtuse angle of minimum value.

In FIG. 15 it will be seen that the angle of the arm of eccentricity 3 of the crank is 337°30′, that the arm of eccentricity of the second eccentric part is at an angle of 67°30′ with respect to a line parallel to the bisecting line or at 90° with respect to arm 3.

Having now established the relative angles between the main parts which have an influence on the drum, and which have been established only by way of example in order to assist explanation, the different behavior of the engine will be discussed below.

Figure 14:
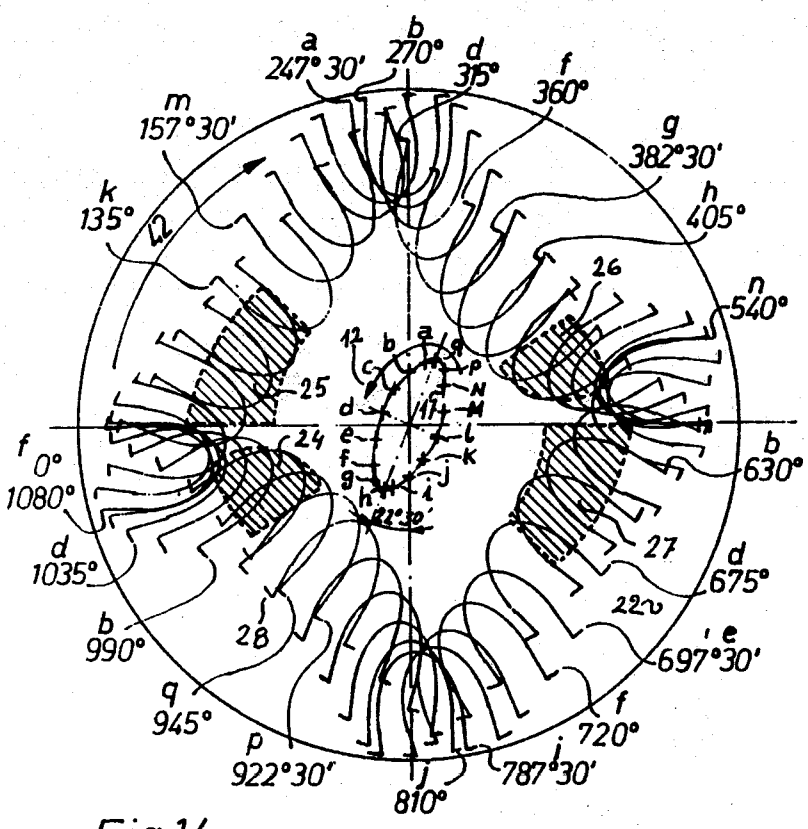
FIG. 14 plots the piston movement for a modification of the engine.

In FIG. 14 a plurality of positions of one concavity or of the three as they follow the same path, have been shown at each 22°30′ as a function of the angle of rotation of the crankshaft. It will be observed in this Figure that a letter is written over each one of the angles which have been marked and which determine one position. This letter represents and coincides with the position of the geometrical center of the drum 21 which, during its orbit in the inverse sense to the rotation of the concavities 12 and 42, describes an elliptical path 17.

When FIG. 14 is studied it will be seen that one of the concavities 28 is shown at forty-eight positions while the positions of its geometrical center, which are marked by dots on its elliptical part 17, are only represented by sixteen. This takes place since for each turn of the crankshaft or complete orbit, the concavities only turn through 120°, so that in order then to pass through 360°, the crank must perform three revolutions, 1080°, and these points marked with letters on the ellipse 17 are repeated and superimposed with each revolution. This ellipse which is described by the geometrical center of the drum using the differing phasing between the two eccentric parts has the same characteristics as the one shown in FIG. 4, but its major diameter is at an angle of 22°30′ with respect to the vertical in the Figure, this angle being the one which the major diameter of the elliptical crown wheel 35 will have, FIG. 12, using this differing arrangement, but this has not been shown in order to avoid repeating illustrations.

Figure 17:
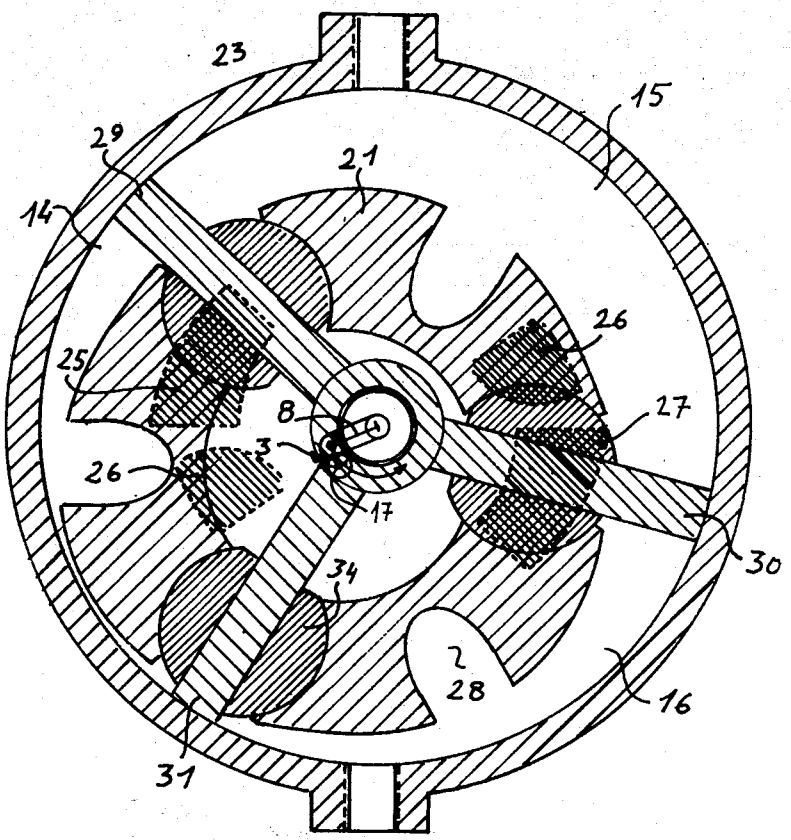
Figure 16:
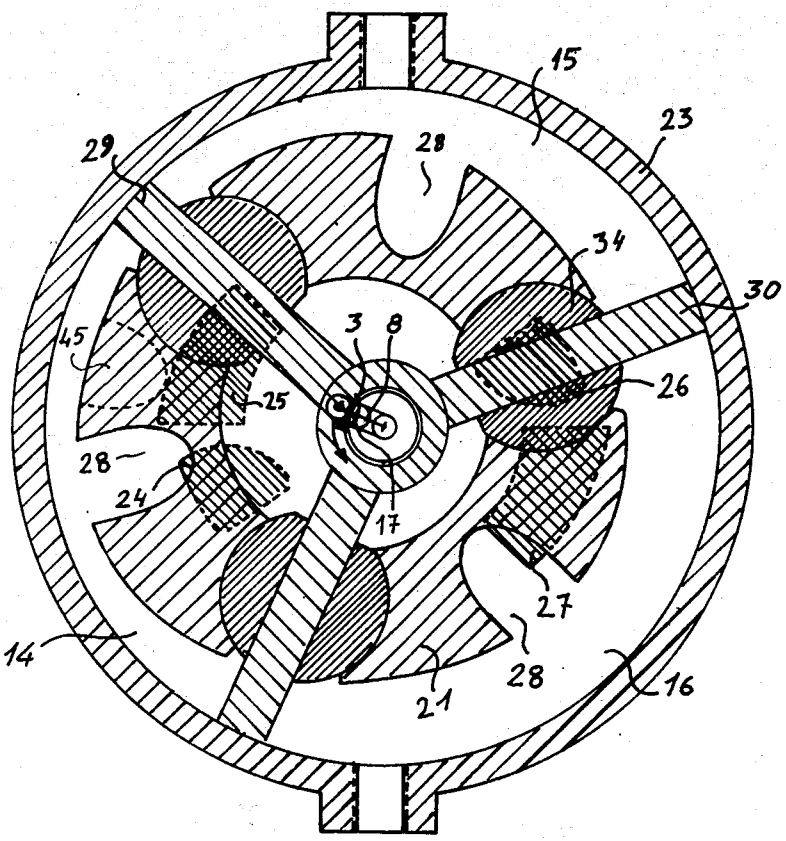

FIGS. 15, 16 and 17 show the same radial cross-section of the engine provided with this differing arrangement, at different positions in the working cycle.

Figure 18:
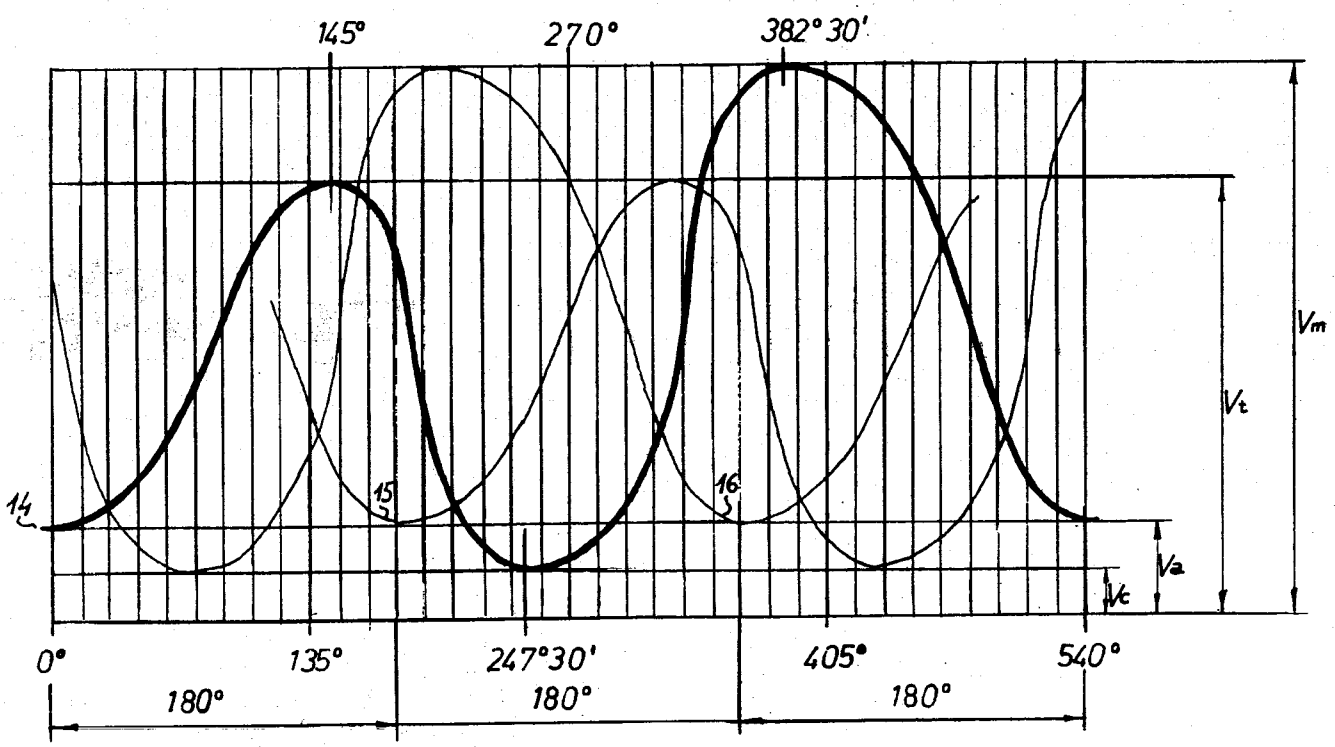
FIG. 18 illustrates the relation between chamber volume and crank rotation for the modification of FIGS. 14–17.

FIG. 18, in a similar manner, is a diagram which relates the angle of rotation of the crank with the volume of the chambers, and reflects the development of the movements shown in FIG. 14.

In order to follow the working cycle more easily, the initial position of 0° has been taken as TDC (top dead center) at the point at which an intake stroke is commencing. This 0° position should not be confused with the position used above for determining the relationship of the eccentric parts based on the bisecting line of the vanes, when these have a minimum angle between them, since an angle of 270° is present between these two positions.

If FIG. 14 is now studied and the path of the concavity 28 is followed in the sense indicated by arrow 42, it will be seen that at 0° the concavity has just finished closing the exhaust port 24 and is starting to open the inlet port 25. If now its path is followed it will be seen that this concavity fully coincides with the inlet port and does not close it until approximately 145°, which is when the chamber reaches its maximum volume during the intake period. This path has been taking place over a period of 145°, being the volume difference or actual swept volume per chamber equal to Vt-Va, FIG. 18, and the orbital displacement described by the geometrical center of the drum has been from position "f" to position "k" on the ellipse 17.

If the path of the concavity is now followed further, it will be seen that starting at 145° the chamber decreases in volume up to the point where 247°30′ is reached. This compression stroke, which has taken place with the valves closed, has taken place in only 102°30′ and the volume difference has been Vt-Vc, FIG. 18, this difference being greater than that occurring during the intake period and the geometrical center 17 of the drum having passed from position "k" to position "a". In this position, (ignoring advance) ignition or injection takes place and the compression ratio is Vt:Vc.

Starting from 247°30′, the chamber increases in volume up to 382°30′. During this period of time the valves have remained closed, and a power stroke of 135° has occurred with a volume variation of Vm-Vc, FIG. 18, which is the maximum achieved. The orbital path described by the geometrical center of the drum has followed the ellipse from position "a" up to position "g".

Starting from 382°30′, the volume of the chamber starts to decrease and concavity 28 opens the exhaust port 26 until its TDC position is reached at 540° at which the concavity again starts to close the port. During this exhaust portion of the cycle, the geometrical center of the drum will have passed from position "g" to position "n" and the duration will have been 157°30′.

The absolute behavior of each chamber, both as regards volume and displacements during its cycle, is different during each portion of the cycle. This can be explained by comparing the intake period which occurs over 145° with the exhaust period which occurs over 157°30′; the inlet port 25 is actually much larger than the exhaust port 26, but notwithstanding this, the arithmetic mean when taking their cross-sections and opening times into account, is approximately the same for both ports, without taking into account overlap, advance or delay which, in order to take the most general case, have here been made to coincide with the periods of maximum or minimum volume.

Starting from 540° up to 1080°, this chamber represented by concavity 28, the path of which has just been followed, will once again perform an identical four stroke cycle at the other half of the cylinder, the overall assembly being diametrically symmetrical in its essential components.

FIGS. 15, 16 and 17 show various positions in the working cycle which are also shown in FIG. 14, and when these are compared it will be seen that in FIG. 15 the geometrical center 17 of the drum 21 is at position "b" on the ellipse 17, chamber 14 is at 990° during an exhaust stroke, chamber 15 is at 270° during a power stroke and chamber 16 is at 630° during an intake stroke.

In FIG. 16 the geometrical center of the drum is at position "α" on ellipse 17, chamber 14 is at 1035° and is coming to the end of the exhaust stroke, chamber 15 is at 315° during the power stroke and chamber 16 is at 675° during an intake stroke, and is about 10° away from the point where this chamber reaches its maximum volume during this part of the cycle and port 27 becomes closed.

In FIG. 17, the geometrical center of the drum is at position "f", chamber 14 is at TDC at 0° at the end of an exhaust stroke and an intake stroke is just starting. Chamber 15 is at 360° during a power stroke and in this position it is 220°30′ away from the position where it achieves its maximum volume (BDC) and the exhaust port 26 opens. Chamber 16 is at 720° during a compression stroke.

One of the most important aspects of this engine is its thermodynamic behavior which occurs at the end of the compression stroke and during the power stroke, the explanation of which will be gone through in greater detail, since this is one of the preferred aims of the invention.

If the position of chamber 15 in the position occupied in FIG. 15 is now observed, where it is at 270°, it will be seen that the vanes 29 and 30 are at a minimum angle with respect to each other, but the chamber 15 does not have its minimum volume at this position but rather this actually takes place at some 20° before the positions shown in the drawing, or, in other words, at about 270°. This difference in phasing occurs since, although the vanes do in one sense open out starting from this position causing the volume of the chamber to increase, the angular relationship between the two arms of eccentricity 3 and 8 is more obtuse and as a result of this, the distance between the center 17 of the drum and the center 32 of the cylinder increases, which does cause the volume of the chamber to decrease, but in fact the chamber of minimum volume is formed when this decrease in volume is balanced by the increase produced by the angular separation of the vanes, which is also an effect caused by the rotation. In a similar manner, but in the reverse sense, a chamber of maximum volume is formed.

It will also be noticed in FIG. 15 that the perimeter of the drum between two vanes is not circular, but is in fact generated by the maximum distance, ignoring tolerances, existing between its center 17 and the internal wall of cylinder 23 at all the points of maximum approximation which are imposed by the reverse rotation of the present double eccentricity.

Continuing the study of FIG. 15, it will be seen that in this position the drum 21 subdivides chamber 15 into two sub-chambers 43 and 44, in a manner which at first glance is similar to what would exist in an engine which was not provided with the double eccentricity, but a very great difference will be seen when the motion performed between the positions in FIGS. 15 and 16 is studied, which is reproduced in FIG. 14 in which the drum is not subject to a rolling effect so that sub-chamber 43, using this system, does not trap the gases due to the fact that the height of the drum decreases at an angle which is fairly close to the vertical from the beginning, as can be seen from the curve described by concavity 28, FIG. 14, during the combustion phase starting at 247°30′ and extending to 382°30′.

When firing or injection occurs, which actually takes place at approximately 22°30′ before the position shown in FIG. 15, the arm of crank 3 will be aligned with the vertical, so that no driving couple is produced directly, but arm 8 of the second eccentric part will be at 52°30′ from the vertical and will be subjected to a torsional force. This torsional moment of arm 8 of the second eccentric part 7, FIGS. 1 and 2, will be opposed by a reaction at the point of rolling, or engagement, between pinion 6 and crown wheel 10, thus causing the geometrical center 4 of the pinion 6 to describe a circular orbit 12, which is in the reverse sense to its rotation 13 as due to the construction, it coincides with arm 3 of crank 1, but precisely because this center is the point of action of the resulting force which acts perpendicularly on arm 3 of the crank, this force will impose a driving couple on it.

This is extremely important, since when the chamber is at minimum volume, during the combustion phase, and the pressure is very high, the engine under consideration is already in possession of a very considerable driving couple, as will also be seen in FIG. 14, when the geometrical center of the drum is located at position "a", having passed over the cap of ellipse 17 and now being in a position where it is descending quite rapidly.

In the position shown in FIG. 15 in which the crank has already turned through 20°30′ and the amount of expansion is not yet appreciable due to the decrease in the angle between the vanes which has counteracted the expansive effect caused by the passage of the geometrical center of the drum from position "a" to position "b", FIG. 14, and it will be seen in this position that the arm of the crank 3 is at 22°30′ from the vertical so that it is now directly subject to a couple, but it will also be seen that arm 8 of the second eccentric part is at 67°30′ with respect to the vertical, or there is 90° between the eccentricities, and the two torsional moments, which act in opposing senses (similar to a "scissors" effect), and these become added together in the same sense, as has already been explained, thus increasing the couple almost at the beginning of the power stroke.

In the drawings shown in FIGS. 14–17, the concavities have been shown as located at the midpoint between two swivel joints as that the plot shown in FIG. 14 will be a more clear representation of the motion of the perimeter of the drum which determines the variation in chamber size, but these concavities may also be situated at any other point whatsoever, such as for example, at the position of the imaginary concavity 45 indicated with dotted lines in FIG. 16 in which, the volume, displacements and angles of the chambers, as well as the ellipse 17 which is described by its geometrical center, will not vary, and the diagram shown in FIG. 18 will be almost identical, but the shape of the path described by this concavity 45 would be similar to the path described by concavities 28 in FIG. 4 with a phase difference which is proportional to that existing between the concavities 28 and 45. In this imaginary position, the phase difference between the ports would be the same and the area of opening would be similar to what has been shown in FIGS. 4–9 so that despite this difference in areas, practically the same opening and flow-time would be maintained.

In the present description, two graphs, FIGS. 3 and 18, have been selected as being representative and provided by way of example only, these showing respectively, two identical engines differing only by a different phasing between the two eccentric parts and the drum, but since the combination of the relative angles between these three parts plus the differing location of the concavities can vary over an extremely wide range which cannot of course all be represented in graphs, but despite the impossibility of showing these, it is quite possible to make a comparative deduction of intermediate behavior existing between these two particular arrangements. The performance of these arrangements could also be changed simply by exchanging the inlet manifold with the exhaust manifold, and vice-versa, and causing the engine to rotate in the reverse sense, which would have the effect of producing a change in the volumetric displacements and their relationships at differing times in the working cycle as well as the angular duration of these, and would thus operate in a similar manner to an engine provided with a compressor.

One of the advantages of the present invention is the plurality of combinations which is possible using the different parts which do make it possible to obtain a wide range of fine variations and possibilities which can easily be adapted to the working conditions to which each particular engine will be subject.

As has already been said above, one of the basic concepts on which this engine is based is a crank system provided with two eccentricities which are mutually synchronized and which cause the geometrical center of the drum to perform a hypocycloidal path, rather than a circular one, which would happen if the engine were not provided with this mechanism.

Figure 20:
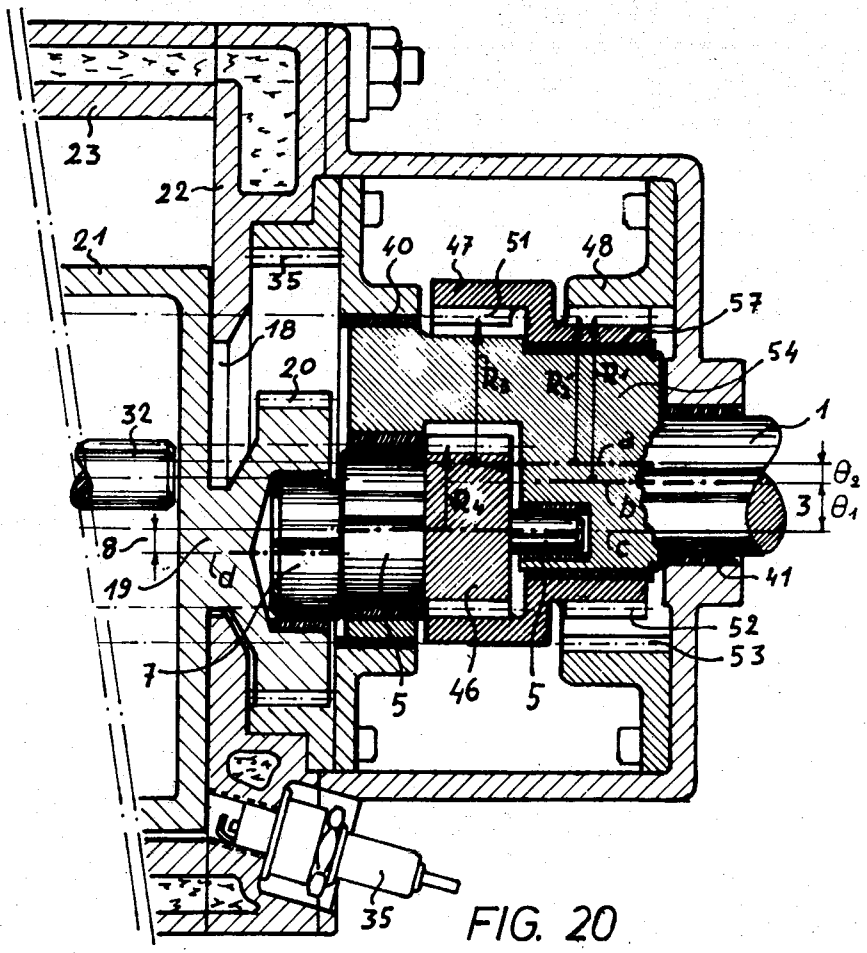
FIGS. 19 and 20 illustrate a modified crank mechanism.
Figure 19:
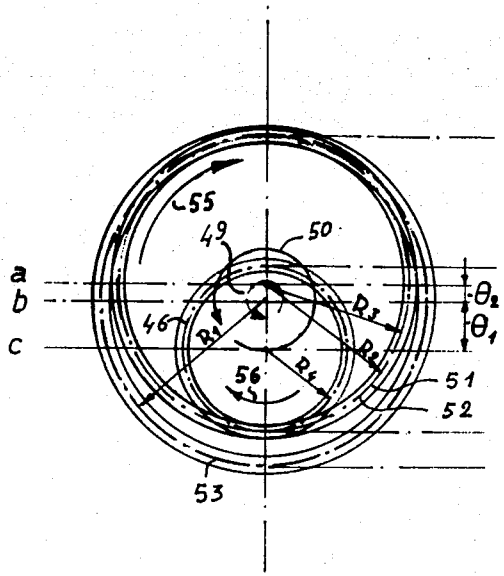

Since the provision of the mechanism is one of the preferred aims of the invention, FIGS. 19 and 20 show a crank system which is similar to the one already described in FIGS. 1, 2, 10, 11 and 13 with the difference that pinion 6, the diameter of which, in the case of the said Figures had to be equal to twice its eccentricity 3 in order that synchronization should not break down, in the alternative embodiment shown in FIGS. 19 and 20, this pinion 6, which in these Figures is indicated with reference numeral 46, has a diameter which is not necessarily limited to twice its eccentricity, but it may in fact be constructed so as to have the most convenient size depending on such factors as manufacturing necessities, mechanical strength or other considerations, its effects on operation however being identical to what has already been described, and consequently the description already provided serves for the two cases.

In order to further clarify the concept on which this fresh mechanism is based, the reasons will be discussed briefly which may prevent one from increasing the diameter of pinion 6 to twice its degree of eccentricity, FIGS. 1, 2, 10, 11 and 13. If the diameter of this pinion were to be increased, it would be necessary to increase the diameter of the static crown wheel 10 by the same extent so that engagement would be ensured over the whole 360° of its orbit, but since this increase in diameter both of the pinion and of the crown wheel would be of the same magnitude, the 2 to 1 engagement ratio would no longer be fulfilled since this increase would have been the same instead of being proportional.

A system which does allow one to increase the diameter of pinion 46, FIGS. 19 and 20, without losing the correct cyclic motion, is provided by locating, between this pinion 46 and the static crown wheel 53 a further intermediate crown wheel 47 which is provided with a double toothing, one on the inside 51 and the other on the outside 52. This crown wheel 47 rotates supported by bearings 57 on the support 54, which is also rotating.

The geometrical center "a" of this crown wheel 47 does not coincide with the goemetrical center of rotation of the crankshaft 1, so that when the said crankshaft rotates about its axis "b", the axis "a" of crown wheel 47 describes a circular orbit 49, FIG. 19, with a radius of eccentricity which is equal to $\theta_2$, FIGS. 19 and 20. This crown wheel 47, which will be caused to perform two motions, one of which is rotation about its geometrical axis "a", and the other of which is the orbital motion 49 about the geometrical axis of the crankshaft "b", will have its inner set of teeth 51 engaging the pinion 46 and its outer teeth 52 engaging the inner toothing 53 of the static crown wheel 48.

Pinion 46, which has the task of causing the second eccentric part 7 to rotate cyclically, will in its turn be caused to perform two motions, one of which is rotation about its geometrical axis "c" and the other of which is the orbital motion 50, FIG. 19, about axis "b" of the crankshaft which in fact is the arm of eccentricity 3, and which equals $\theta_1$, FIGS. 19 and 20.

This gearing arrangement consists of the following parts with their constructional detail: Firstly pinion 46 with an effective radius $R_4$; secondly the arm of crankshaft 3, the orbital path 50 of which has a radius $\theta_1$; thirdly, $R_3$ which is the effective internal radius 51 of the orbital crown wheel 47, for which it is recommended that it be about 80 to 85% greater than $R^4$ so that its proportions might be more rational.

The unknowns which it is necessary to find in order that the cycle described above is complied with will be $R_2$ and $R_1$. $R_2$ will be the outer effective radius 52 of the orbital crown wheel 47 and $R_1$ will be the internal effective radius 53 of the static crown wheel 48 which is concentric with shaft "b".

With respect to the gearing ratio between the known radii $R_4$ and $R_3$ and the unknown radii $R_2$ and $R_1$, the situation must exist that for each turn of the crankshaft, pinion 46 must also perform one revolution but in the reverse sense, as was the case with the crank system described in FIGS. 1 and 2.

With reference now to FIGS. 19 and 20, it will be noticed that the radius of the orbit 49 which is described by the geometrical center of crown wheel 47 which is made up so as to have an inner toothing 51 and an outer toothing 52, is $\theta_2=R_3-R_4-\theta_1$.

The equation which relates the known data, ignoring for the moment how it is established, is $R_2=(R_3\cdot\theta_2)/(2\cdot R_4-R_3)$; but if the Figures are studied again, it will be seen that although the values of $R_1$ and $R_2$ are not known, the relationship $R_1-R_2=\theta_2$ must always be present, from which $R_1=R_2+\theta_2$, so that now the two unknowns $R_1$ and $R_2$ are also known.

In FIGS. 19 and 20, the radii $R_3$ and $R_2$ have been shown as being identical in order to demonstrate that this is possible, but more often than not, they will be different.

It is also possible for other equations to exist which determine the gearing relationship, and the present one has been given solely by way of example since this would not change the basic operation of the engine.

This crank system, which is more robust than the one described in FIGS. 1 and 2, may be applied to only one side of the engine, to both sides of the engine, or it may be mixed, in other words at the side at which the power shaft passes out from the engine, making use of the system in FIGS. 19 and 20 on the side opposing that shown in FIGS. 1, 2, 10, 11 and 13, in order to accompany the same motion, or to provide a suitable point for connecting the timing mechanism, lubrication system, balance wheels or other suitable parts.

The present description and drawings are based, by way of example, on one single motor body, but it is of course possible to accommodate more operating on one common shaft, operating at suitable angles with respect to each other.

No details have been given of the systems providing ignition, lubrication, cooling, sealing, bearing arrangements and other complementary parts, since these can be varied over a wide range and will not basically affect the present invention, and of course it is also possible to vary the number of vanes and their corresponding gearing relationship, or substitute an ignition system using electrical discharge by injection of the fuel under high pressure etc., but all these variations do not change the basic idea of this new system.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rotary-piston internal combustion engine having a housing provided with an inner cylindrical wall defined about a housing axis and defining therein a substantially cylindrical piston-confining chamber, a piston positioned within said chamber and supported for rotation relative to said housing, said piston including a shell-like drum and a plurality of vanes which are angularly spaced about said housing axis and project radially outwardly therefrom through the periphery of said drum and have the radially outer ends thereof disposed in rotatable slidable engagement with the inner wall of said housing, the piston also including slidable swivel means coacting between the vanes and the drum for permitting the drum to be radially slidably displaced relative to the vanes so that the drum can move eccentrically within the chamber relative to said housing axis, a shaft rotatably supported relative to said housing in coaxial alignment with said housing axis, and a crank mechanism connected between said shaft and said drum for controlling the rotational path of movement of the drum within the chamber, the improvement wherein the crank mechanism comprises:

a first crank fixed to said shaft for rotation therewith, said first crank defining a first eccentric axis which is substantially parallel to and radially spaced from the rotational axis of said shaft;

a second crank rotatably supported on said first crank for rotation relative thereto about said first eccentric axis, said second crank defining thereon a second eccentric axis which is parallel to and radially spaced from said first eccentric axis;

said piston drum being rotatably supported on said second crank for rotation relative thereto about said second eccentric axis; and gear means reacting between said second crank and said stationary housing for causing rotation of said second crank relative to said first crank so that said drum is moved in an hypocycloidal path within said chamber.

2. An engine according to claim 1, wherein the gear means includes a pinion fixedly secured to said second crank in coaxial alignment with said first eccentric axis, and a ring gear fixed to said housing in coaxial alignment with said housing axis and disposed in direct meshing engagement with said pinion.

3. An engine according to claim 2, wherein the pinion has a diameter equal to twice the radial spacing between said shaft axis and said first eccentric axis, and said ring gear having a diameter equal to twice the effective diameter of said pinion.

4. An engine according to claim 1, including side plates fixedly secured to the opposite sides of the housing for closing the sides of said chamber to thereby confine the piston therein, said side plate having a central elongated passage formed therein, said drum having a coaxial hub projecting outwardly through said passage and being rotatably supportingly engaged with said second crank.

5. An engine according to claim 4, wherein the piston is provided with only three vanes substantially uniformly spaced therearound, a pair of circumferentially adjacent inlet and exhaust ports communicating with said chamber at one location, and a further pair of circumferentially adjacent inlet and exhaust ports communicating with said chamber at a second location which is substantially diametrically opposite said first location, said ports being formed in at least one of the side plates which close the sides of said chamber and spaced radially inwardly a substantial distance from said inner cylindrical wall, said drum being divided by said vanes into three substantially identical arcuate sectors, each of said sectors having a flow-control concavity projecting radially inwardly thereof from the outer periphery of the sector, the sectors of said drum normally closing said intake and exhaust ports, with these ports being individually opened during rotation of the drum for communication with the sub-chamber defined between an adjacent pair of vanes due to a partial uncovering of the respective port by the respective concavity.

6. An engine according to claim 1, wherein said piston is provided with only three said vanes spaced approximately uniformly therearound and dividing said drum into three arcuate sectors, the external periphery of said drum being noncylindrical, and the radial dimension from the axis of said drum to the peripheral midpoint of the sector being less than the radial dimension to the periphery of the sectors in the vicinity of the vanes, whereby the periphery of each sector has a configuration which closely approximates the cylindrical configuration of said inner cylindrical wall.

7. An engine according to claim 1, wherein said gear means includes a pinion fixedly secured to said second crank in coaxial alignment with said first eccentric axis, said pinion being meshingly interconnected to a ring gear which is fixed to said housing in coaxial alignment with said housing axis.

8. An engine according to claim 7, wherein said gear means includes an intermediate gear which is rotatably supported relative to said housing in eccentric relationship relative to both said pinion and said ring gear, said intermediate gear having first and second sets of teeth thereon disposed in direct meshing engagement with said pinion and said ring gear, respectively.

9. An engine according to any one of claims 1, 2, 7 or 8, including further gear means reacting between said piston and said housing for causing relative rotation therebetween, said further gear means including a pinion fixedly secured to and coaxially aligned with said drum and disposed in meshing engagement with a larger ring gear which is fixedly secured to said housing, said ring gear having the geometric center thereof coaxially aligned with the housing axis, said ring gear being elliptical.

10. In a rotary-piston internal combustion engine having a housing provided with an inner cylindrical wall defined about a housing axis and defining therein a substantially cylindrical piston-confining chamber, a piston positioned within said chamber and supported for rotation relative to said housing, said piston including a shell-like drum and a plurality of vanes which are angularly spaced about said housing axis and project radially outwardly therefrom through the periphery of said drum and have the radially outer ends thereof disposed in rotatable slidable engagement with the inner wall of said housing, the piston also including means coacting between the vanes and the drum for permitting the drum to be radially slidably displaced relative to the vanes so that the drum can move eccentrically within the chamber relative to said housing axis, and an output shaft rotatably supported relative to said housing in coaxial alignment with said housing axis, the improvement comprising:

a motion transmitting and controlling device coacting between said shaft, said drum and said housing for causing the drum to be moved in a hypocycloidal path within said chamber;

said device including rotatable eccentric means connected between said shaft and said drum, said eccentric means including two rotatable eccentrics connected in series between said shaft and said drum, said two eccentrics being eccentric relative to said shaft and to each other; and said device also including gear means meshingly reacting between said housing and one of said drum and eccentric means.

11. An engine according to claim 10, wherein said gear means includes a first gear mechanism meshingly reacting between said housing and one of said eccentrics, and a second gear mechanism meshingly reacting between said housing and said drum.

12. An engine according to claim 10 or 11, wherein one of said eccentrics is fixed to said output shaft for rotation therewith, the other of said eccentrics being rotatably supported on said one eccentric for rotation relative thereto about a first axis which is eccentrically displaced relative to the rotational axis of said shaft, and said drum being interconnected to and rotatably supported relative to said second eccentric for rotation relative to said second eccentric about a second axis which is eccentrically displaced relative to both said shaft axis and said first axis.

13. An engine according to claim 12, wherein said first gear mechanism meshingly reacts between said housing and said other eccentric for causing said other eccentric to make one complete revolution in one direction about said first axis while said one eccentric makes one complete revolution in the opposite direction about said shaft axis.

14. In a rotary-piston internal combustion engine having a housing provided with an inner cylindrical wall defined about a housing axis and defining therein a substantially cylindrical piston-confining chamber, said housing having at least one sidewall provided with a central opening therethrough, a piston positioned within said chamber and supported for rotation relative to said housing, said piston including a shell-like drum and a plurality of vanes which are angularly spaced about said housing axis and project radially outwardly therefrom through the periphery of said drum and have the radially outer ends thereof disposed in rotatable slidable engagement with the inner wall of said housing, the piston also including means coacting between the vanes and the drum for permitting the drum to be radially slidably displaced relative to the vanes so that the drum can move eccentrically within the chamber relative to said housing axis, the drum having a coaxial hub fixed thereto and projecting axially through said central opening, a power output shaft rotatably supported relative to said housing in coaxial alignment with said housing axis, a cylindrical pinion concentrically fixed relative to said drum, and a ring gear fixed to said housing in surrounding relationship to said pinion and in concentric relationship to said housing axis, said pinion during orbital motion of said drum being disposed in meshing engagement with said ring gear at a single location for causing rotation of the drum about its own axis in an inverse rotational sense relative to the direction of rotation of the drum along its orbital path, the improvement comprising:

a motion transmitting and controlling means coacting between said output shaft and said drum for causing the center axis of the drum as it rotates and orbits within the chamber to describe a hypocycloidal orbit having an elliptical shape, said means including a crank system connected between said output shaft and said drum, said crank system including two series-connected rotatable eccentrics, and said means also including a synchronizing mechanism connected to said crank system for controlling the relative rotation between said two rotatable eccentrics.

15. An engine according to claim 14, wherein said two rotatable eccentrics comprise first and second rotatable cranks, said first crank being fixed to and rotatable with said output shaft, said second crank being rotatably supported on said first crank for rotation about a first axis which is parallel to but radially displaced from the rotational axis of said output shaft for defining a first eccentricity, said drum being rotatably supported on said second crank about a second axis which is parallel with and radially displaced relative to said first axis for defining a second eccentricity, and said synchronizing mechanism including a reactive gearing mechanism provided with a pinion gear nonrotatably fixed to said second crank and movable with its rotational axis along an orbital path due to rotation of said first crank, said gearing mechanism reacting with said pinion gear for causing it to rotate about its own axis in a reverse sense relative to its direction of rotation about its own orbital path.

16. An engine according to claim 15, wherein the pinion gear is nonrotatably fixed to said second crank in coaxial alignment with said first axis, said drum being rotatably supported on said second crank so that the central axis of said drum is aligned with said second axis, and said gearing mechanism causing said second axis to move through an orbital elliptical path having a major diameter equal to twice the first eccentricity plus twice the second eccentricity and a minor diameter equal to twice the first eccentricity minus twice the second eccentricity.

17. An engine according to claim 15 or 16, wherein the gearing mechanism includes a stationary crown wheel with inner teeth which is arranged concentrically with respect to said shaft axis, said pinion gear being disposed in direct meshing engagement with said stationary crown wheel.

18. An engine according to claim 17, wherein the pinion gear has an effective tooth diameter equal to twice said first eccentricity, and wherein said stationary crown wheel has an effective tooth diameter equal to twice the effective tooth diameter of said pinion gear.

19. An engine according to claim 15 or 16, wherein said gearing mechanism includes a stationary crown wheel with an inner toothing which is arranged concentrically with respect to the shaft axis, and a nonstationary intermediate gear wheel meshingly interconnects said pinion gear to said crown wheel, said intermediate gear wheel having an inner toothing disposed in direct engagement with said pinion gear and an outer toothing disposed in meshing engagement with said stationary crown wheel.

20. An engine according to claim 19, wherein said pinion gear has an effective tooth diameter which is not equal to twice said first eccentricity, said intermediate gear wheel being rotatably supported on said shaft for rotation relative to said shaft about a third axis which is parallel to but radially displaced from said shaft axis so that said intermediate gear wheel both rotates and orbits, the radial displacement between said third axis and said shaft axis being equal to the effective radius of the inner toothing of said intermediate crown gear minus the effective radius of the toothing on the pinion gear minus said first eccentricity, and the effective radius of the inner toothing of said intermediate crown wheel is twice the effective radius of the toothing on the pinion gear, and the effective radius of the outer toothing of said intermediate crown gear is equal to the effective radius of the inner toothing of said intermediate crown gear multiplied by the eccentricity between said third axis and said shaft axis, with this product being divided by twice the difference between the effective tooth radius of the pinion gear and the effective tooth radius of the inner toothing on the intermediate gear wheel.

21. An engine according to claim 20, wherein the stationary crown wheel has inner toothing with an effective radius equal to the sum of the effective radius of the outer toothing of the intermediate gear wheel plus the radial eccentricity between said third axis and said shaft axis.

22. An engine according to claim 14, wherein the crank system is interconnected to the hub of said drum by an intermediate bearing which allows the drum to rotate about its own central axis with said latter axis being aligned with said second axis, whereby the only part of the drum which describes said hypocycloidal path is its central axis, and wherein said stationary crown wheel has an elliptical shape.

23. An engine according to claim 22, wherein the pinion as affixed to said drum has an effective diameter equal to six times said first eccentricity, said pinion being directly meshingly engaged with the inner toothing defined by said stationary crown wheel, the major diameter of the elliptical crown wheel being equal to eight times said first eccentricity plus two times said second eccentricity, and the minor diameter of said elliptical crown wheel being equal to eight times said first eccentricity minus two times said second eccentricity.

24. An engine according to claim 14, wherein the central opening as formed in said side cover is elliptical for allowing the hub which connects the pinion to the drum to pass therethrough during the orbital movement of the drum, and said sidewall having inlet and exhaust ports formed therein which are cyclically opened and closed by the drum itself during its orbital and rotational movement, said drum having concavities formed laterally therein so as to register with said inlet and outlet ports during the orbital and rotational movement of said drum, said inlet and outlet ports as formed in said sidewall being positioned in the vicinity of the minor diameter of the elliptically-shaped central opening.

25. An engine according to claim 24, wherein said drum has at least one said concavity formed in the periphery thereof between each two adjacent vanes, said concavity being located at one axial end of the drum directly adjacent said sidewall, said concavities being angularly spaced apart around the periphery of said drum by angular spacings which approximately equal the angular spacings between said vanes.

26. An engine according to claim 24 or 25, wherein said sidewall is provided with four ports which open therethrough and are distributed symmetrically in two groups which are at 180° intervals with respect to each other, each one of these groups including said exhaust and inlet ports disposed in close proximity to one another, each group of ports being located in the region of the minor axis of the central elliptical opening and in the region between the central elliptical opening and the minimum area which the drum traverses during its rotational and orbital movement, said drum completely covering said ports at any position on its path except at those positions when the concavities coincide with the ports.

27. An engine according to claim 24, including one or more ignition means associated with said housing for initiating combustion, said ignition means being associated with said sidewall and located at a position which coincides with the concavities when they are positioned approximately corresponding to top dead center at the end of each intake stroke.

28. An engine according to claim 16, wherein said gearing mechanism causes said pinion gear and said second crank to make one complete revolution in one direction about said first axis while said first crank makes one complete revolution in the opposite direction about said housing axis.

* * * * *